US009467239B1

(12) United States Patent
Colby et al.

(10) Patent No.: US 9,467,239 B1
(45) **Date of Patent: *Oct. 11, 2016**

(54) CONTENT CUSTOMIZATION IN COMMUNICATION SYSTEMS

(76) Inventors: Steven M. Colby, Mountain View, CA (US); Tamara S. Colby, Mountain View, CA (US)

( * ) Notice: Subject to any disclaimer, the term of this patent is extended or adjusted under 35 U.S.C. 154(b) by 893 days.

This patent is subject to a terminal disclaimer.

(21) Appl. No.: 12/978,868

(22) Filed: Dec. 27, 2010

Related U.S. Application Data

(63) Continuation of application No. 12/781,659, filed on May 17, 2010, now Pat. No. 8,346,157, which is a continuation-in-part of application No. 11/155,146, filed on Jun. 16, 2005, now Pat. No. 7,720,432.

(60) Provisional application No. 60/580,242, filed on Jun. 16, 2004.

(51) Int. Cl.
*H04H 1/00* (2006.01)
*H04H 20/28* (2008.01)
*H04H 20/10* (2008.01)

(52) U.S. Cl.
CPC ..... *H04H 20/28* (2013.01); *H04H 20/10* (2013.01)

(58) Field of Classification Search
CPC .... H04H 20/106; H04H 60/51; H04H 20/26; H04H 20/31; H04H 20/34; H04H 20/38; H04H 60/16; H04H 60/23; H04H 60/37; H04H 60/40; H04H 60/43; H04H 60/46; H04H 60/65; H04H 60/72; G06Q 30/02
USPC ..... 455/3.01, 3.03, 3.04, 556.1, 412.1, 455/3.02, 3.06, 186.1; 705/14.42, 26, 27, 705/27.1, 1, 14.45, 14.4, 14.61, 14.72, 705/14.67, 14; 707/771, 10, 102, 2, 9, 200, 707/E17.032; 725/14, 32, 35, 34, 42, 46, 725/47, 97, 48, 14.49, 14.53, 36, 38, 109, 725/62, 63, 39, 118, 37, 135, 141, 74, 82, 725/106, 10, 112, 116; 709/213, 231, 217, 709/202, 203; 715/500.1, 501.1, 723, 760; 375/240.12, 240.25, 240.24; 386/52, 386/55, 68, 111, 117, 125, 95; 345/723, 345/721, 726, 719; 726/1, 26, 17
See application file for complete search history.

(56) References Cited

U.S. PATENT DOCUMENTS 4,930,158 A 5/1990 Vogel
5,155,591 A 10/1992 Wachob
(Continued)

FOREIGN PATENT DOCUMENTS

EP 0701371 3/1996
EP 0982732 3/2000
(Continued)

OTHER PUBLICATIONS

Extended European Search Report for Application No. 05821316.6 dated Sep. 3, 2010, 8 pages.
(Continued)

*Primary Examiner* — Tan H Trinh

(57) ABSTRACT

Systems and methods for providing customization in asymmetric communication are disclosed. An excess of information is broadcast from a transmitter to multiple receivers in what is optionally a one-way transmission. The excess of information includes metadata used to select which subset of the excess of information is presented to a user and which subset of the excess of information is discarded. The metadata includes criteria that are compared with various, possibly different, customization factors stored on each of the multiple receivers. This comparison is used to determine which subsets of the excess information are presented and which are discarded. Because the customization factors can be different on different receivers, customization of the presented information is achieved. The customization factors optionally include geographic information resulting in customization based on a receiver location. The excess information optionally includes radio or television signals. In some embodiments, a nationally broadcast signal results in the presentation of advertisements, where the presentation is customized to a specific location.

9 Claims, 10 Drawing Sheets

(56) References Cited

U.S. PATENT DOCUMENTS 5,191,573 A 3/1993 Hair
5,200,825 A * 4/1993 Perine ..... 348/722
5,233,423 A 8/1993 Jernigan
5,303,393 A 4/1994 Noreen et al.
5,455,823 A 10/1995 Noreen et al.
5,559,562 A * 9/1996 Ferster ..... 348/584
5,600,368 A 2/1997 Matthews, III
5,675,734 A 10/1997 Hair
5,689,245 A 11/1997 Noreen et al.
5,703,795 A 12/1997 Mankovitz
5,721,583 A 2/1998 Harada et al.
5,774,172 A 6/1998 Kapell et al.
5,774,664 A 6/1998 Hidary et al.
5,781,228 A 7/1998 Sposato
5,796,952 A 8/1998 Davis et al.
5,809,144 A 9/1998 Sirbu et al.
5,844,620 A 12/1998 Coleman et al.
5,859,660 A 1/1999 Perkins et al.
5,907,323 A 5/1999 Lawler et al.
5,926,624 A 7/1999 Katz et al.
5,930,765 A 7/1999 Martin
5,963,916 A 10/1999 Kaplan
6,002,720 A 12/1999 Yurt et al.
6,005,563 A 12/1999 White et al.
6,018,768 A 1/2000 Ullman et al.
6,029,045 A 2/2000 Picco et al.
6,044,376 A 3/2000 Kurtzman, II
6,088,722 A 7/2000 Herz et al.
RE36,801 E 8/2000 Logan et al.
6,122,011 A 9/2000 Dias et al.
6,144,375 A * 11/2000 Jain et al. ..... 715/251
6,169,541 B1 1/2001 Smith
6,177,931 B1 1/2001 Alexander et al.
6,226,618 B1 5/2001 Downs
6,233,389 B1 5/2001 Barton et al.
6,240,555 B1 5/2001 Shoff et al.
6,264,559 B1 7/2001 Lawrence et al.
6,268,856 B1 7/2001 Bruck et al.
6,324,694 B1 11/2001 Watts et al.
6,327,346 B1 12/2001 Infosino
6,330,665 B1 12/2001 Wise
6,357,042 B2 3/2002 Srinivasan et al.
6,377,747 B1 4/2002 Murase et al.
6,381,362 B1 4/2002 Deshpande
6,407,750 B1 6/2002 Gioscia et al.
6,411,335 B1 6/2002 Jang
6,425,127 B1 7/2002 Bates et al.
6,434,195 B1 * 8/2002 Luthra et al. ..... 375/240.12
6,437,836 B1 8/2002 Huang et al.
6,446,261 B1 * 9/2002 Rosser ..... 725/34
6,487,721 B1 11/2002 Safadi
6,502,194 B1 12/2002 Berman et al.
6,539,423 B1 3/2003 Ebert
6,549,942 B1 4/2003 Janky et al.
6,553,077 B2 4/2003 Rindsberg et al.
6,553,178 B2 4/2003 Abecassis
6,587,127 B1 7/2003 Leeke et al.
6,588,015 B1 7/2003 Eyer et al.
6,601,237 B1 7/2003 Ten Kate
6,608,556 B2 8/2003 De Moerloose et al.
6,615,251 B1 9/2003 Klug et al.
6,628,928 B1 9/2003 Crosby et al.
6,637,032 B1 10/2003 Feinleib
6,698,020 B1 2/2004 Zigmond et al.
6,718,551 B1 4/2004 Swix et al.
6,721,489 B1 4/2004 Beanyamin
6,728,713 B1 4/2004 Beach et al.
6,728,730 B1 4/2004 Muro et al.
6,738,808 B1 5/2004 Zellner et al.
6,741,862 B2 5/2004 Chung et al.
6,763,379 B1 7/2004 Shuster
6,769,028 B1 7/2004 Sass
6,774,920 B1 8/2004 Cragun
6,785,656 B2 8/2004 Patsiokas et al.
6,823,225 B1 11/2004 Sass
6,829,711 B1 12/2004 Kwok et al.
6,832,084 B1 12/2004 Deo et al.
6,947,976 B1 9/2005 Devitt et al.
6,952,221 B1 * 10/2005 Holtz et al. ..... 715/723
6,965,770 B2 11/2005 Walsh
6,973,669 B2 12/2005 Daniels
7,017,173 B1 3/2006 Armstrong et al.
7,020,888 B2 3/2006 Reynolds et al.
7,047,302 B1 5/2006 Chatani et al.
7,113,999 B2 9/2006 Pestoni
7,136,871 B2 11/2006 Ozer et al.
7,158,666 B2 1/2007 Deshpande et al.
7,158,943 B2 1/2007 Van Der Riet
7,159,232 B1 1/2007 Blackketter et al.
7,180,917 B1 2/2007 Marko et al.
7,228,555 B2 * 6/2007 Schlack ..... 725/35
7,231,651 B2 6/2007 Pong
7,363,000 B2 4/2008 Fishman et al.
7,454,166 B2 11/2008 Patsiokas et al.
7,555,020 B2 6/2009 Marko
7,577,732 B2 * 8/2009 Yasui et al. ..... 709/223
7,610,011 B2 10/2009 Albrett
7,630,986 B1 * 12/2009 Herz et al.
7,631,327 B2 * 12/2009 Dempski et al. ..... 725/34
7,631,330 B1 12/2009 Des Jardins
7,650,617 B2 1/2010 Hoshino et al.
7,685,615 B2 3/2010 Bertin
7,706,740 B2 4/2010 Collins et al.
7,720,432 B1 5/2010 Colby et al.
7,721,307 B2 * 5/2010 Hendricks et al. ..... 725/34
7,725,580 B1 5/2010 Weigand et al.
7,769,756 B2 * 8/2010 Krikorian et al. ..... 707/736
7,788,395 B2 8/2010 Bowra
7,801,743 B2 9/2010 Graves et al.
7,822,381 B2 10/2010 Mantel
7,877,776 B2 1/2011 Krikorian et al.
7,882,140 B1 2/2011 DiLorenzo
8,032,648 B2 10/2011 Bodlaender
8,260,665 B2 * 9/2012 Foladare et al. ..... 705/14.5
8,290,425 B2 * 10/2012 Albrett ..... 455/3.04
2001/0025256 A1 9/2001 Oliphant
2001/0026677 A1 * 10/2001 Chen et al. ..... 386/68
2001/0044736 A1 11/2001 Jacobs et al.
2002/0002488 A1 * 1/2002 Muyres et al. ..... 705/14
2002/0010759 A1 1/2002 Hilson
2002/0013784 A1 1/2002 Swanson
2002/0016736 A1 2/2002 Cannon et al.
2002/0029384 A1 3/2002 Griggs
2002/0063714 A1 5/2002 Haas et al.
2002/0066026 A1 5/2002 Yau et al.
2002/0075318 A1 6/2002 Yang et al.
2002/0092019 A1 * 7/2002 Marcus ..... 725/37
2002/0116313 A1 8/2002 Detering
2002/0168963 A1 11/2002 Wajs
2002/0184237 A1 12/2002 McFeely
2002/0196850 A1 12/2002 Liu et al.
2003/0005464 A1 1/2003 Gropper et al.
2003/0016673 A1 1/2003 Pendakur et al.
2003/0023973 A1 1/2003 Monson et al.
2003/0033197 A1 2/2003 Saga et al.
2003/0037157 A1 2/2003 Pestoni
2003/0050058 A1 3/2003 Walsh et al.
2003/0061206 A1 3/2003 Qian
2003/0072556 A1 4/2003 Okujima et al.
2003/0093353 A1 5/2003 Ward et al.
2003/0093790 A1 5/2003 Logan et al.
2004/0024636 A1 2/2004 Jaffe et al.
2004/0024688 A1 2/2004 Bi
2004/0034874 A1 * 2/2004 Hord et al. ..... 725/136
2004/0098753 A1 * 5/2004 Reynolds et al. ..... 725/135
2004/0103429 A1 5/2004 Carlucci et al.
2004/0116070 A1 6/2004 Fishman et al.
2004/0158858 A1 * 8/2004 Paxton et al. ..... 725/42
2004/0194131 A1 9/2004 Ellis et al.
2004/0197088 A1 * 10/2004 Ferman et al. ..... 386/117
2004/0216163 A1 * 10/2004 Whitcomb ..... 725/74
2004/0244035 A1 12/2004 Wright et al.
2004/0261096 A1 12/2004 Matz
2005/0021845 A1 * 1/2005 Yasui et al. ..... 709/238

(56) References Cited

U.S. PATENT DOCUMENTS

| | | | | |
|---|---|---|---|---|
| 2005/0033864 | A1* | 2/2005 | Matsushima et al. | 710/1 |
| 2005/0097599 | A1 | 5/2005 | Plotnick et al. | |
| 2005/0193410 | A1 | 9/2005 | Eldering | |
| 2005/0249080 | A1 | 11/2005 | Foote et al. | |
| 2006/0015904 | A1* | 1/2006 | Marcus | 725/46 |
| 2006/0040609 | A1 | 2/2006 | Petschke et al. | |
| 2006/0041921 | A1 | 2/2006 | Hane | |
| 2006/0085349 | A1 | 4/2006 | Hug | |
| 2006/0085351 | A1 | 4/2006 | Hug | |
| 2006/0085352 | A1 | 4/2006 | Hug | |
| 2006/0085815 | A1* | 4/2006 | Nguyen-Tran | 725/34 |
| 2006/0136967 | A1 | 6/2006 | Hellman | |
| 2006/0167956 | A1 | 7/2006 | Chasen et al. | |
| 2006/0190970 | A1 | 8/2006 | Hellman | |
| 2007/0014536 | A1 | 1/2007 | Hellman | |
| 2007/0061215 | A1 | 3/2007 | Waites | |
| 2007/0061838 | A1* | 3/2007 | Grubbs et al. | 725/35 |
| 2007/0088852 | A1 | 4/2007 | Levkovitz | |
| 2007/0112627 | A1 | 5/2007 | Jacobs et al. | |
| 2007/0136742 | A1 | 6/2007 | Sparrell | |
| 2007/0140318 | A1 | 6/2007 | Hellman | |
| 2007/0150338 | A1* | 6/2007 | Malik | 705/14 |
| 2007/0157228 | A1 | 7/2007 | Bayer et al. | |
| 2007/0226761 | A1* | 9/2007 | Zalewski et al. | 725/32 |
| 2007/0234213 | A1* | 10/2007 | Krikorian et al. | 715/716 |
| 2008/0004957 | A1 | 1/2008 | Hildreth et al. | |
| 2008/0033805 | A1 | 2/2008 | Padin | |
| 2008/0040666 | A1 | 2/2008 | Wang et al. | |
| 2008/0052739 | A1 | 2/2008 | Logan | |
| 2008/0052741 | A1 | 2/2008 | Dharmaji | |
| 2008/0059997 | A1 | 3/2008 | Plotnick | |
| 2008/0060000 | A1 | 3/2008 | Drouet | |
| 2008/0127252 | A1 | 5/2008 | Eldening et al. | |
| 2008/0127266 | A1 | 5/2008 | Ward | |
| 2008/0195457 | A1 | 8/2008 | Sherman | |
| 2008/0195468 | A1 | 8/2008 | Malik | |
| 2008/0201734 | A1* | 8/2008 | Lyon et al. | 725/34 |
| 2008/0261512 | A1 | 10/2008 | Milbrandt et al. | |
| 2008/0276270 | A1* | 11/2008 | Kotaru et al. | 725/34 |
| 2008/0305736 | A1 | 12/2008 | Milbrandt et al. | |
| 2008/0320545 | A1* | 12/2008 | Schwartz | 725/135 |
| 2009/0022165 | A1 | 1/2009 | Candelore | |
| 2009/0031419 | A1 | 1/2009 | Laksono | |
| 2009/0076906 | A1 | 3/2009 | Kansal | |
| 2009/0094648 | A1 | 4/2009 | Patel | |
| 2009/0150966 | A1 | 6/2009 | Alao | |
| 2009/0210902 | A1* | 8/2009 | Slaney et al. | 725/34 |
| 2009/0217318 | A1 | 8/2009 | Versteeg | |
| 2009/0244371 | A1 | 10/2009 | Park | |
| 2009/0249426 | A1 | 10/2009 | Aoki | |
| 2009/0254971 | A1* | 10/2009 | Herz et al. | 726/1 |
| 2009/0300480 | A1 | 12/2009 | Cohen | |
| 2009/0307732 | A1 | 12/2009 | Cohen | |
| 2009/0310932 | A1 | 12/2009 | Hsieh et al. | |
| 2009/0320075 | A1 | 12/2009 | Marko | |
| 2010/0023863 | A1 | 1/2010 | Cohen-Martin | |
| 2010/0043022 | A1 | 2/2010 | Kaftan | |
| 2010/0049603 | A1* | 2/2010 | Peterson et al. | 705/14.45 |
| 2010/0049719 | A1* | 2/2010 | Payne et al. | 707/10 |
| 2010/0058380 | A1 | 3/2010 | Yu | |
| 2010/0058381 | A1 | 3/2010 | Begeja et al. | |
| 2010/0058382 | A1* | 3/2010 | Yu et al. | 725/35 |
| 2010/0082440 | A1* | 4/2010 | Vaidyanathan et al. | 705/14.72 |
| 2010/0083306 | A1* | 4/2010 | Dempski et al. | 725/34 |
| 2010/0088717 | A1 | 4/2010 | Candelore | |
| 2010/0105315 | A1* | 4/2010 | Albrett | 455/3.04 |
| 2010/0122285 | A1 | 5/2010 | Begeja | |
| 2010/0122286 | A1* | 5/2010 | Begeja et al. | 725/34 |
| 2010/0122288 | A1* | 5/2010 | Minter et al. | 725/36 |
| 2010/0122305 | A1 | 5/2010 | Moloney | |
| 2010/0154007 | A1 | 6/2010 | Touboul | |
| 2010/0169910 | A1 | 7/2010 | Collins | |
| 2010/0211982 | A1 | 8/2010 | Lee et al. | |
| 2010/0242063 | A1 | 9/2010 | Slaney et al. | |
| 2010/0251289 | A1 | 9/2010 | Agarwal | |
| 2010/0269138 | A1* | 10/2010 | Krikorian et al. | 725/39 |
| 2010/0275221 | A1 | 10/2010 | DuVall et al. | |
| 2010/0300699 | A1 | 12/2010 | Papon | |
| 2011/0010737 | A1 | 1/2011 | Bouazizi | |
| 2011/0063503 | A1 | 3/2011 | Brand | |
| 2011/0066706 | A1 | 3/2011 | Ostrover | |
| 2011/0145370 | A1 | 6/2011 | Nieuwenhuys | |
| 2011/0149992 | A1 | 6/2011 | Sharma | |
| 2011/0167486 | A1 | 7/2011 | Ayloo | |
| 2012/0180083 | A1* | 7/2012 | Marcus | 725/32 |
| 2013/0079127 | A1* | 3/2013 | Malik | 463/29 |
| 2014/0089241 | A1* | 3/2014 | Hoffberg et al. | 706/14 |

FOREIGN PATENT DOCUMENTS

| | | | |
|---|---|---|---|
| EP | 1337125 | | 8/2003 |
| EP | 1548741 | | 6/2005 |
| EP | 1712977 | | 10/2006 |
| JP | 09-288699 | A | 11/1997 |
| JP | 08-063482 | | 3/1998 |
| JP | 11-259930 | A | 9/1999 |
| JP | 2000-308094 | A | 11/2000 |
| JP | 2000358005 | A | 12/2000 |
| JP | 2001-111921 | A | 4/2001 |
| JP | 2001346140 | A | 12/2001 |
| JP | 2002271736 | A | 9/2002 |
| JP | 2002280982 | A | 9/2002 |
| JP | 2002290957 | A | 10/2002 |
| JP | 2002366472 | A | 12/2002 |
| JP | 2003168044 | A | 6/2003 |
| JP | 2003179901 | A | 6/2003 |
| JP | 2005084752 | A | 3/2005 |
| JP | 2006510965 | A | 3/2006 |
| KR | 20010070863 | A | 7/2001 |
| KR | 20010088762 | A | 9/2001 |
| TW | 522386 | B | 3/2003 |
| TW | 589846 | B | 6/2004 |
| TW | 128893 | | 3/2005 |
| TW | 1237511 | | 8/2005 |
| WO | 9722207 | A1 | 6/1997 |
| WO | 9848566 | A2 | 10/1998 |
| WO | 9918518 | A2 | 4/1999 |
| WO | 9927681 | A2 | 6/1999 |
| WO | 9930493 | A1 | 6/1999 |
| WO | 0033578 | A1 | 6/2000 |
| WO | 0102836 | A1 | 1/2001 |
| WO | 0219581 | A1 | 3/2002 |
| WO | 0245316 | A2 | 6/2002 |
| WO | 03048948 | A1 | 6/2003 |
| WO | 2004003879 | A2 | 1/2004 |
| WO | 2004038966 | A1 | 5/2004 |
| WO | 2004055807 | A1 | 7/2004 |
| WO | 2006027660 | A1 | 3/2006 |

OTHER PUBLICATIONS

International Search Report in Application No. PCT/US2005/033306 dated Jul. 8, 2008, 2 pages.

International Preliminary Report in Application No. PCT/US2005/033306 dated Mar. 10, 2009, 1 page.

Written Opinion in Application No. PCT/US2005/033306 dated Jul. 8, 2008, 6 pages.

Supplemental European Search Report in Application No. 05821316.6 dated Aug. 26, 2010, 2 pages.

Office Action in U.S. Appl. No. 11/229,383 dated Oct. 3, 2008, 30 pages.

Response to Office Action in U.S. Appl. No. 11/229,383 dated Oct. 3, 2008, mailed Jan. 27, 2009, 24 pages.

Notice of Allowance in U.S. Appl. No. 11/229,383 dated Apr. 2, 2009, 41 pages.

Notice of Allowance in U.S. Appl. No. 11/229,383 dated Jun. 18, 2009, 46 pages.

Translation of Japanese Office Action, dated Feb. 18, 2008, for corresponding Japanese Pat. App. No. 2003-520191.

Fischetti, M., "The Future of TV," Technology Review, Nov. 2001, pp. 35-40.

(56) References Cited

OTHER PUBLICATIONS

"Video Games as Ad Medium?" http://www.consolewire.com/news/item.asp?nid=1175, May 2, 2001, 3 pages.
"Boxster, GeForce 256 launch demo," http://developer.nvidia.com/view.asp?ID=Boxster, Nov. 22, 1999.
Gena, C, and Ardissono, L., "On the Construction of TV Viewer Stereotypes Starting from Lifestyles Surveys," Proc. UM2001 Workshop on Personalization in Future TV, Sonthofen, Germany, Jul. 2001.
Hua, K. A., Ying, C., and Sheu S., "Patching: A Multicast Technique for True Video-on-Demand Services," Proc. 6th ACM Int'l Multimedia Conf., Sep. 1998, pp. 191-200.
International Search Report, dated Jan. 31, 2003, for corresponding international application No. PCT/EP02/08816.
Taiwan Search Report—TW096100633—TIPO—Sep. 13, 2011.
International Search Report, PCT/US07/060248, International Search Authority, European Patent Office, Jan. 12, 2008.
Written Opinion, PCT/US07/060248, International Search Authority, European Patent Office, Jan. 12, 2008.
International Preliminary Report on Patentability, PCT/US07/060248, The International Bureau of WIPO, Geneva, Switzerland, Dec. 16, 2008.
www.fourthwallmedia.tv/Technology/Intellectual-Property/
(Printed Sep. 20, 2012). Note reference to "Client-side data reduction."
U.S. Appl. No. 12/781,659, Colby, Content Customization in Communication Systems, filed May 17, 2010.
U.S. Appl. No. 11/821,465, Schwartz, Richard T.
U.S. Appl. No. 12/242,406 Non-Final Office Action issued Sep. 26, 2013.
U.S. Appl. No. 12/267,284 Non-Final Office Action issued Aug. 20, 2013.
U.S. Appl. No. 11/821,465 Final Office Action issued Jun. 23, 2010.
U.S. Appl. No. 12/490,688 Final Office Action issued Jun. 19, 2013.
U.S. Appl. No. 12/198,417 Final Office Action issued Dec. 11, 2012.
U.S. Appl. No. 12/827,964 Non-Final Office Action issued Jun. 19, 2013.
U.S. Appl. No. 12/198,454 Final Office Action issued Nov. 8, 2012.

* cited by examiner

CONTENT CUSTOMIZATION IN COMMUNICATION SYSTEMS

CROSS-REFERENCE TO RELATED APPLICATIONS

This application is a continuation of U.S. patent application Ser. No. 12/781,659 filed May 17, 2010 now U.S. Pat. No. 8,346,157 and entitled "Content Customization in Asymmetric Communication Systems," which, in turn, is a continuation-in-part of U.S. patent application Ser. No. 11/155,146 filed Jun. 16, 2005 now U.S. Pat. No. 7,720,432 and entitled "Content Customization in Asymmetric Communication Systems"; which in turn claims benefit of U.S. provisional patent application Ser. No. 60/580,242, filed Jun. 16, 2004 and entitled "Content Customization in Asymmetric Communication Systems." The disclosures of the above patent applications are hereby incorporated herein by reference.

BACKGROUND

1. Field of the Invention

The invention is in the field of broadcasting and more specifically in the field of broadcast content customization.

2. Related Art

Prior art communications can be categorized by the degree to which the communication is symmetric. A symmetric communication model allows each party to the communication to transmit and receive with approximately equal ability. For example, a connection between two cell phones is symmetric because each party technically has an equal ability to send and receive. An asymmetric communication is one in which one party does most of the transmitting and the other party does most of the receiving. For example, prior art television broadcasts are asymmetric because one party does most of the broadcasting and (many) other parties do most of the receiving. Some communication models are neither purely symmetric nor asymmetric. For example, pay per view television involves a party making a request over a telephone line. This request is a symmetric communication. If the request is successful, then the requestor may receive keys to decrypt an asymmetric broadcast of a television program.

Typically, a high degree of symmetry is required in communication where parties transmit data specifically intended for each other, or where users can actively request individually customized content. Examples of highly symmetric communication include user initiated web content serving, person-to-person telephony (whether digital or analog), and conference calls (whether physically transmitted on the Internet, the PSTN, or some combination of transport technologies). In such highly symmetric communication models, feedback amongst parties to a given communication is typically rapid, and allows for frequent and/or more specific customization of content transmitted between (and/or among) the parties.

In contrast, a highly asymmetric communication, such as satellite, cable, or internet broadcasting systems, allows little feedback between parties to the communication and customization of content is more difficult because these communications are often unidirectional. Where given content is consumable by a large number of parties, such as in satellite television or XM radio, asymmetric communication is usually preferred. Asymmetric communications make more effective use of bandwidth and mean that a transmitter does not also have to have substantial receiving capability. However, the prior art lacks an efficient method for providing customization in highly asymmetric communications involving many receivers.

SUMMARY OF THE INVENTION

The invention includes systems and methods for providing improved customization in asymmetric communication. An excess of information is transmitted from a sender to a plurality of receivers, for example, through a one-way broadcast. The excess of information includes more information that would normally be conveyed to a user in real time. For example, the excess information may include 12 minutes of audio data broadcast in an 8-minute period. As is further described herein, customization is achieved by selecting various subsets of the 12 minutes of audio data to present to different users during the 8 minute of real time.

At each receiver, a subset of the excess information is presented to (e.g., conveyed to or perceived by) a user in response to a variety of possible factors. These factors are used to customize what the user perceives by selecting which of the excess information is presented to the user and which of the excess information is discarded. The customization factors can include, for example, location of the user, a subscription status, a type of receiving device, an identity of the user, a demographic of the user, etc.

In various embodiments, the transmitted information includes metadata configured for determining which sections of a transmission can be customized in response to the customization factors. For example, in some embodiments, a transmission includes persistent content, referred to herein as "primary data," that is normally conveyed to a user without alteration and variable content, referred to herein as "auxiliary data," that is subject to customization. These two types of content are optionally distinguished by metadata.

In some embodiments, more than one transmission channel is used to transmit the transmitted information. For example, one transmission channel may be used to transmit a first set of information that can be conveyed to a user in real time and a second transmission channel may be used to transmit a second set of information that is excess information. The excess information is optionally configured for replacing parts of the first set responsive to customization factors. The second set is optionally transmitted using a different transmitter. For example, a nationwide satellite broadcast may transmit the first set of information and a local broadcast tower may transmit the second set. In some embodiments, a single transmission channel is used to transmit both information that can be conveyed to a user in real time and excess information. This transmission channel may be, for example, a digital radio or digital television channel.

In various embodiments, of the invention, the transmitted information includes textual, image, audio and/or video information, or the like.

Various embodiments of the invention include a system comprising: a signal receiver configured to receive an excess of information including one or more primary data sequences and a plurality of auxiliary data sequences, the one or more primary data sequences being configured to be normally included in a customized data output and members of the plurality of auxiliary data sequences being configured to be included in the customized data output subject to a comparison between criteria associated with the auxiliary data sequences and one or more customization factors; a parser configured to identify the one or more primary data sequences, the plurality of auxiliary data sequences, and the criteria, in the excess of information; and an output assembler configured to include the primary data sequences in the customized data output, to access the customization factors, and to include a subset of the plurality of auxiliary data sequences in the customized data output responsive to the comparison between the criteria and the customization factors.

Various embodiments of the invention include a system comprising: a signal receiver configured to receive a signal in a plurality of channels, the signal including more information than would normally be presented to a user in real time; a parser configured to identify a plurality of auxiliary data sequences within the received signal, and to identify criteria for determining which of the plurality of auxiliary data sequences to included in a customized data output; a customization factor storage configured to store one or more customization factors received from a geographic location device or a user input; and an output assembler configured to generate the customized data output by comparing the one or more customization factors with the criteria an to include one or more members of the plurality of auxiliary data sequences in the customized data output responsive to the comparison.

Various embodiments of the invention include a system comprising: primary data storage configured to store primary data to be included in a data transmission, the data transmission including an excess of information and being configured for generating a customized data output; auxiliary data storage configured to store auxiliary data to be included in the customized data output responsive to a comparison between one or more customization factors stored at a receiver and criteria included in the data transmission, the criteria optionally including geographic relevance data or access control data; a scheduler configured to specify the criteria, associate the criteria with the auxiliary data and to generate corresponding metadata; a metadata inserter configured to combine the metadata and the auxiliary data; and an assembler configured to assemble the primary data, auxiliary data, metadata and criteria into transmission data for inclusion in the data transmission. Optionally further including a transmitter configured to transmit the transmission data.

Various embodiments of the invention include a method of generating transmission data, the method comprising: optionally identifying a primary data sequence for presentation to an end-user; identifying a plurality of auxiliary data sequences for presentation to the end-user responsive to a location of the end-user or access control data stored on a receiver of the end-user, determining criteria for presentation of one or more members of the auxiliary data sequences to the end-user; associating the determined criteria with the one or more members of the plurality of auxiliary data sequences; determining metadata configured for distinguishing members of the auxiliary data sequences and optionally the primary data; optionally assigning channels for transmission of the transmission data; and assembling the metadata, optionally the primary data sequence, the plurality of auxiliary data sequences, and the criteria into the transmission data. Optionally transmitting the transmission data to a plurality of receivers at different locations of a user such that end-users associated with each of the plurality of receivers are presented with a different presentation responsive to their locations. The criteria are optionally inserted into the auxiliary data.

Various embodiments of the invention include a system comprising a signal receiver configured to receive a broadcast signal from one or more transmitters, the broadcast signal including more data than would normally be presented to a user in real time, a parser configured to identify, within the received broadcast signal, primary data configured to be presented to the user unmodified, auxiliary data for generating customized output data, and criteria for use in selecting, substituting or inserting the auxiliary data to generate the customized output data, customization factors storage configured to store one or more customization factors, and an output assembler configured to generate the customized output data by comparing the criteria with the one or more customization factors and selecting, substituting or inserting the auxiliary data responsive to this comparison.

Various embodiments of the invention include a method of generating customized output data, the method comprising receiving a broadcast at a receiver, the broadcast signal including more data than would normally be presented to a user in real time, parsing the received broadcast to identify primary data configured to be presented to a user, to identify auxiliary data configured for generating customized output data, and to identify criteria for use in selecting, substituting or inserting the auxiliary data to generate the customized output data, accessing one or more customization factors associated with the receiver, comparing the one or more customization factors with the identified criteria, selecting, substituting or inserting the auxiliary data responsive to a result of the comparison between the one or more customization factors and the identified criteria, in order to generate the customized output data.

Various embodiments of the invention include a method of generating a customized output data stream, the method comprising receiving one or more broadcast at a receiver, the one or more broadcast including excess data identifying primary and auxiliary sequences within the excess data identifying criteria within the excess data, the criteria associated with the auxiliary sequences accessing one or more customization factors associated with the receiver comparing the identified criteria with the one or more customization factors in order to determine which of the excess data should be included in the customized output data and which of the excess data should be discarded, and assembling the customized output data responsive to the comparison between the identified criteria and the one or more customization factors.

Various embodiments of the invention include a method of generating transmission data, the method comprising: identifying one or more auxiliary data sequences for presentation to the end-user responsive to a location of the end-user or access control data stored on a receiver of the end-user; determining criteria for presentation of one or more members of the auxiliary data sequences to the end-user, associating the determined criteria with the one or more members of the plurality of auxiliary data sequences; determining metadata configured for distinguishing members of the auxiliary data sequences and optionally the primary data; and optionally assigning channels for transmission of the transmission data; and assembling the metadata, optionally the primary data sequence, the plurality of auxiliary data sequences, and the criteria into the transmission data.

DETAILED DESCRIPTION OF THE INVENTION

Figure 1:
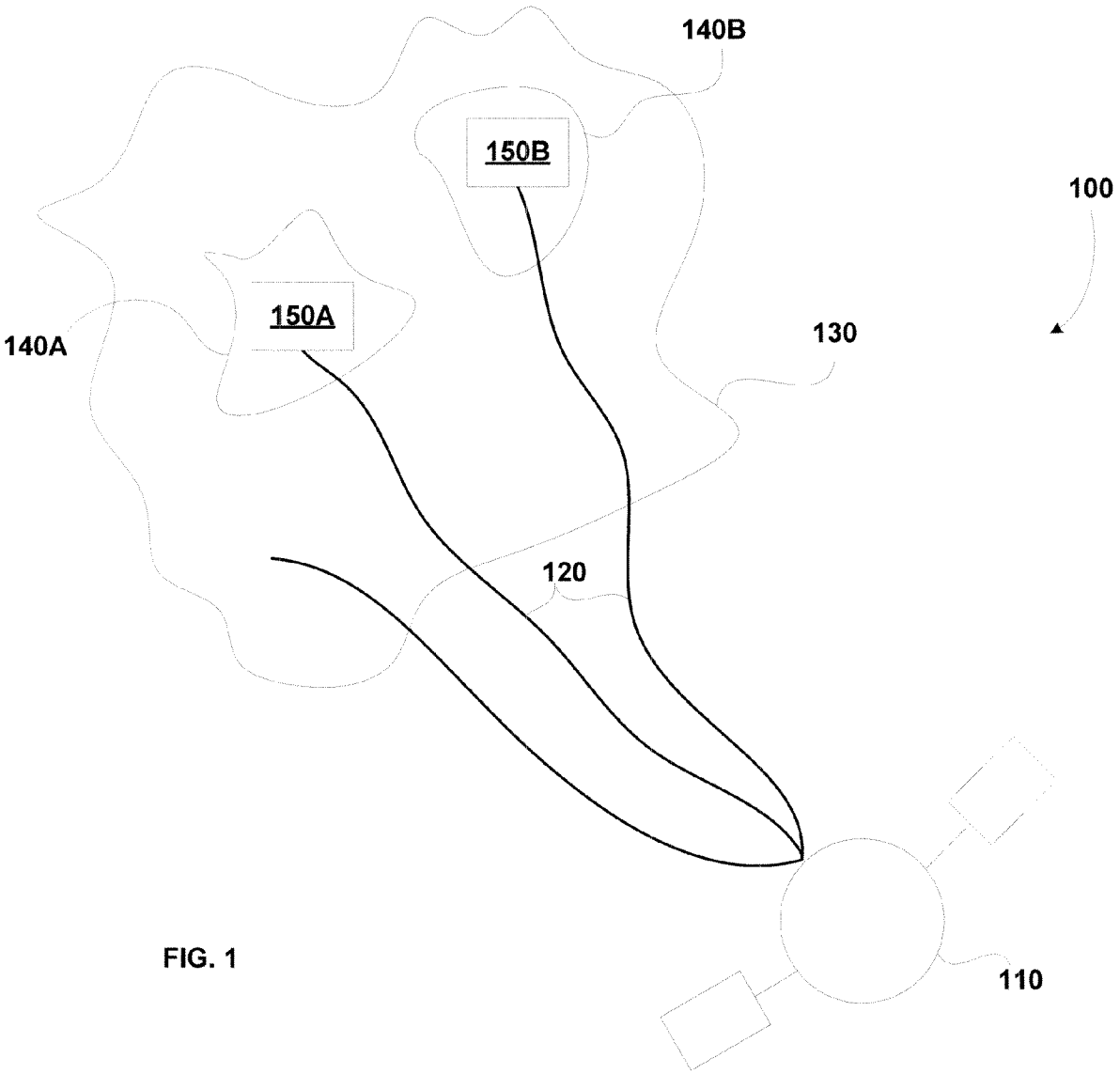
FIG. 1 illustrates a broadcasting system, according to various embodiments of the invention.

An excess of information is provided from a transmitter to a receiver. The information is in excess because more information is provided than would normally be conveyed to a user in real time. A subset of the provided data is included in an output stream from the receiver to be perceived by the user. For example, in some embodiments the receiver is configured to display a video output stream on a television set to be observed by the user. The subset of the provided data is determined responsive to one or more variable customization factors associated with each receiver. Thus, different users may receive different customized output streams resulting from the same broadcast.

The customization factors optionally include geographic information, referred to as the "location of a user." In various embodiments the location of a user includes the output of a global positioning system, data provided to the receiver by the user, data received from a cellular telephone network, data received from a wireless network, data received from motion sensor, data received from a radio beacon triangulation system, or other data relating to geographic or relative position. For example, in some embodiments, a user may enter a zip code to indicate a location of the user. In some embodiments, the location of a user is determined by the detection of a wireless signal. For example, the location of a user is optionally determined to be Santa Fe by detection of a Santa Fe radio station or other local broadcast. The location of a user need not be the physical location of the user. For example, the user may enter a zip code for New York while the user is physically located in San Francisco. The location of a user optionally includes directional information, such as a direction of travel, or a travel history. Thus, a customization factor can include data indicating that a user has just arrived at an airport on a plane, rather than in a car, etc. A customization factor can include that a user is traveling away from a city, rather than toward the city. The location of a user can further include longitude and latitude information, a city name, a street address, a telephone area code, map quadrants, highway numbers, or any other data for identifying a particular physical area.

The customization factors optionally include demographics of a user such as their income, race, sex, age, purchasing habits, travel habits, education, television viewing history, user preference data, or the like.

The customization factors optionally include access control data such as a subscription status, an access key, an encryption key, an identity of the user, or the like. For example, if the customization factors include a subscription status, a user having a subscription may receive a different subset of the excess information than a user not having a subscription. Thus, the user not having the subscription may receive a subset of the excess information that includes commercials, while the user that has the subscription receives a subset with fewer commercial.

The excess information can include digital or analog data. For example, the excess information may include a digital television signal or a digital radio signal. The excess information can be transmitted wirelessly, through a cable, through a fiber optic, or through other means of transmitting data.

FIG. 1 illustrates an example Broadcasting System, generally designated 100. Broadcasting System 100 includes one or more Transmitter 110 configured to transmit Signal 120. Transmitter 110 optionally includes a satellite, a transmitting tower, a flying transmitter, a cable system, a fiber optic system, a telephone system, and/or other system for transmitting excess information in the form of analog or digital data. In some embodiments, Transmitter 110 includes a plurality of devices, such as a geosynchronous satellite and a local transmission tower, or a cable system and a computer network. The combined information transmitted in Signal 120 by the satellite and the transmission tower (or cable system and computer network), in combination, constitute excess information.

Signal 120 is received in a region 130 including Area 140A and Area 140B. Areas 140A and 140B can include larger areas such as countries or states, or include smaller areas such as specific rooms in a house, city blocks, cities, zip codes, streets, regions, neighborhoods, or the like.

Signal 120 is optionally unidirectional. Signal 120 is optionally transmitted over a single transmission channel including excess bandwidth, e.g., more bandwidth than is required to transmit real time data. Transmission channels including excess bandwidth are found in digital television and digital radio. In some embodiments, Signal 120 is transmitted over a plurality of transmission channels, using either one transmitting device or a plurality of transmitting devices. For example, Signal 120 is optionally transmitted at two different radio frequencies from a ground based radio tower, over two different channels using a cable television system, or using a radio frequency signal and a telephone signal.

Signal 120 includes primary data that is presented to a user independently from customization factors and auxiliary data that may be presented to the user dependent on customization factors. Optionally, the primary data is included in a primary data stream and the auxiliary data is included in an auxiliary data stream. The primary data stream and the secondary data stream may be transmitted using different transmission channels.

Within Areas 140A and 140B, the identical Signal 120 is received by a Receiver 150A and a Receiver 150B, respectively. As is further described herein Receivers 150A and 150B are configured to use customization factors and Signal 120 to generate a customized output for presentation to a user.

Figure 2:
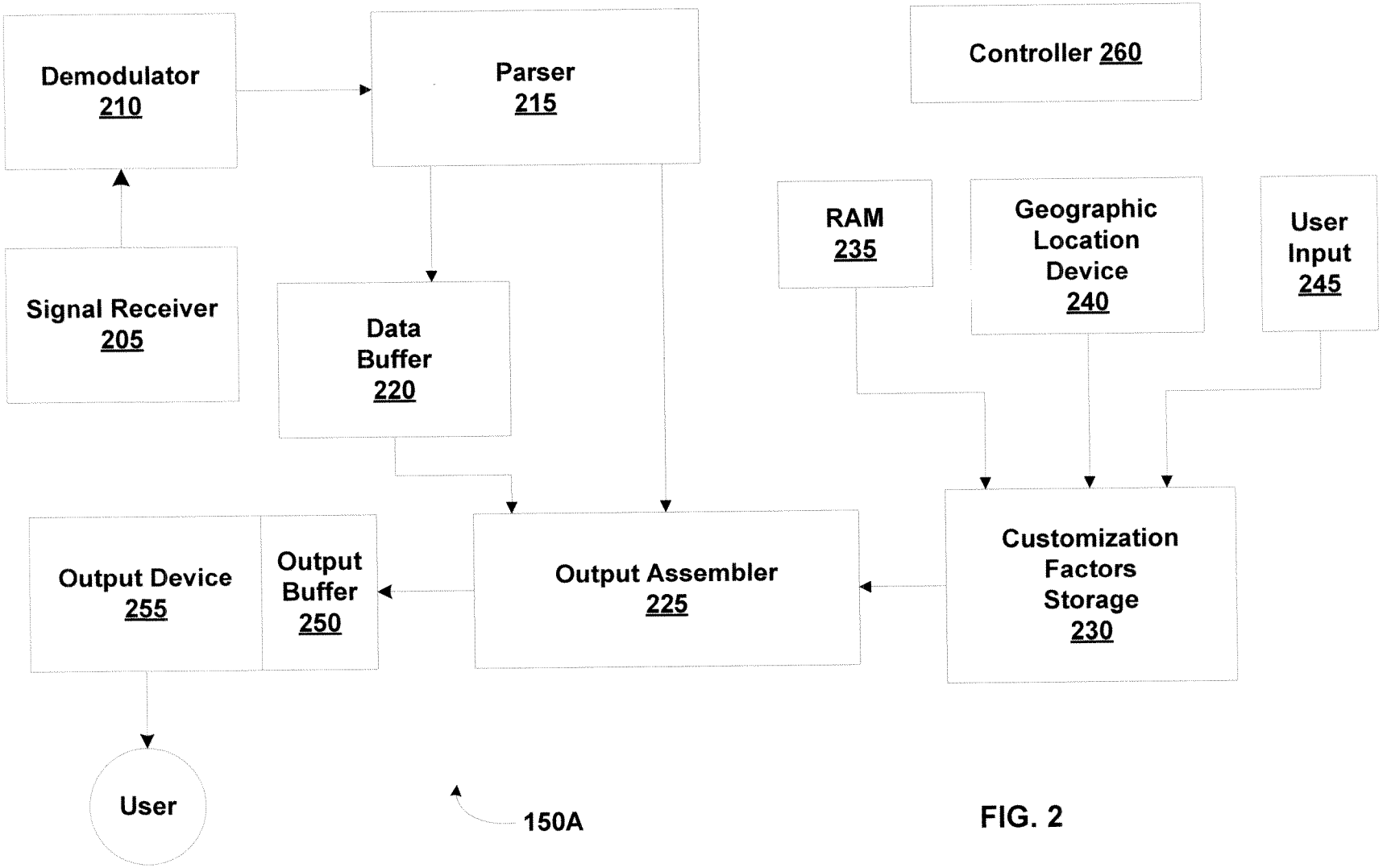
FIG. 2 illustrates a receiver, according to various embodiments of the invention.

FIG. 2 illustrates Receiver 150A or Receiver 150B, according to various embodiments of the invention. Receiver 150A includes a Signal Receiver 205 such as a cable input, antenna, telephone input, fiber optic input, or the like, configured to receive Signal 120 through one or more transmission channels. For example, in some embodiments Signal Receiver 205 includes an antenna located on a roof or dashboard of an automobile, on a roof of a house, or elsewhere that a clear signal path from Transmitter 110 can be achieved.

Receiver 150 optionally further includes a Demodulator 210 configured to tune into a particular portion of Transmitted Signal 110, typically conceptualized as a channel. As is known in the art, the Demodulator 210 reverses the processes used by a modulator for preparing data to be transmitted. Such processes include types of multiplexing, modulation, and error correction schemes, including quadrature phase shift key (QPSK), frequency modulation, frequency division multiplexing, amplitude modulation, time division multiplexing, forward error correction, turbo coding, viturbi coding, and the like. One skilled in the art will be able to select appropriate multiplexing, encoding, and error correction means based on considerations such as available raw bandwidth, characteristics of errors on the channel, type of data being sent, and computing power available to transmit, receive, multiplex, decode, and control these processes. Demodulator 210 is typically configured to generate a digital output in response to the received Signal 120.

The digital output of Demodulator 210 is provided to a Parser 215. Parser 215 is configured to identify those portions of the digital output that represent primary data and those portions that represent auxiliary data. In typical embodiments, primary data and auxiliary data are differentiated using metadata included in Signal 120. The identified primary data or auxiliary data are optionally stored in a Data Buffer 220. For example, auxiliary data may be stored in Data Buffer 220 until discarded or inserted into an output data stream using an Output Assembler 225. In some embodiments, parts of primary data and/or auxiliary data are passed directly to Output Assembler 225 without intermediate storage in Data Buffer 220. Data Buffer 220 optionally includes a FIFO buffer.

Output Assembler 225 is configured to assemble output data for presentation to a user. The output data includes the primary data and a subset of the auxiliary data received in Signal 120. Customization factors are used to determine which of the auxiliary data received in Signal 120 is included in the output data of Output Assembler 225. These customization factors are stored in a Customization Factors Storage 230 and available to Output Assembler 225 when needed to generate output data. Customization Factors Storage 230 can include digital memory, a lookup table, a database, random access memory, or the like.

The customization factors stored in Customization Factors Storage 230 are optionally derived from RAM (random access memory) 235, a Geographic Location Device 240, a User Input 245, or the like. For example, RAM 235, which may also be read only memory) can include a serial number, model number or other data regarding Receiver 150A.

Geographic Location Device 240 can include a wireless global positioning system device, a wireless telephone receiver capable of determining physical location, a local positioning system, or other device configured to determine a location of Receiver 150A. A location determined by Geographic Location Device 240 is optionally stored in Customization Factors Storage 230.

User Input 245 includes an interface configured for a user to input a location of the user, a subscription key, a user identifier, a security key, a street address, a city name, longitude and latitude, or the like. For example, in some embodiments a user can subscribe to a commercial free version of a television or radio station. In exchange for payment, the user receives a subscription key that is associated with a serial number of Receiver 150A. The user then enters the received subscription key into Customization Factors Storage 230 through User Input 245. In another example, a user is in Chicago but wishes to hear radio content customized for San Diego. In this case the user enters a San Diego zip code and requests that this zip code take priority over data received from Geographic Location Device 240, using User Input 245.

The output data generated by Output Assembler 225 is passed to an optional Output Buffer 250 for presentation to a user through Output Device 255. Output Device 255 includes a television monitor, a computer display, video monitor, a speaker, a game display, a gambling device, a navigation system display, or the like.

The operation of Receiver 150A is optionally under the control of a Controller 260, including an integrated circuit, software, firmware, hardware, or the like.

Figure 3:
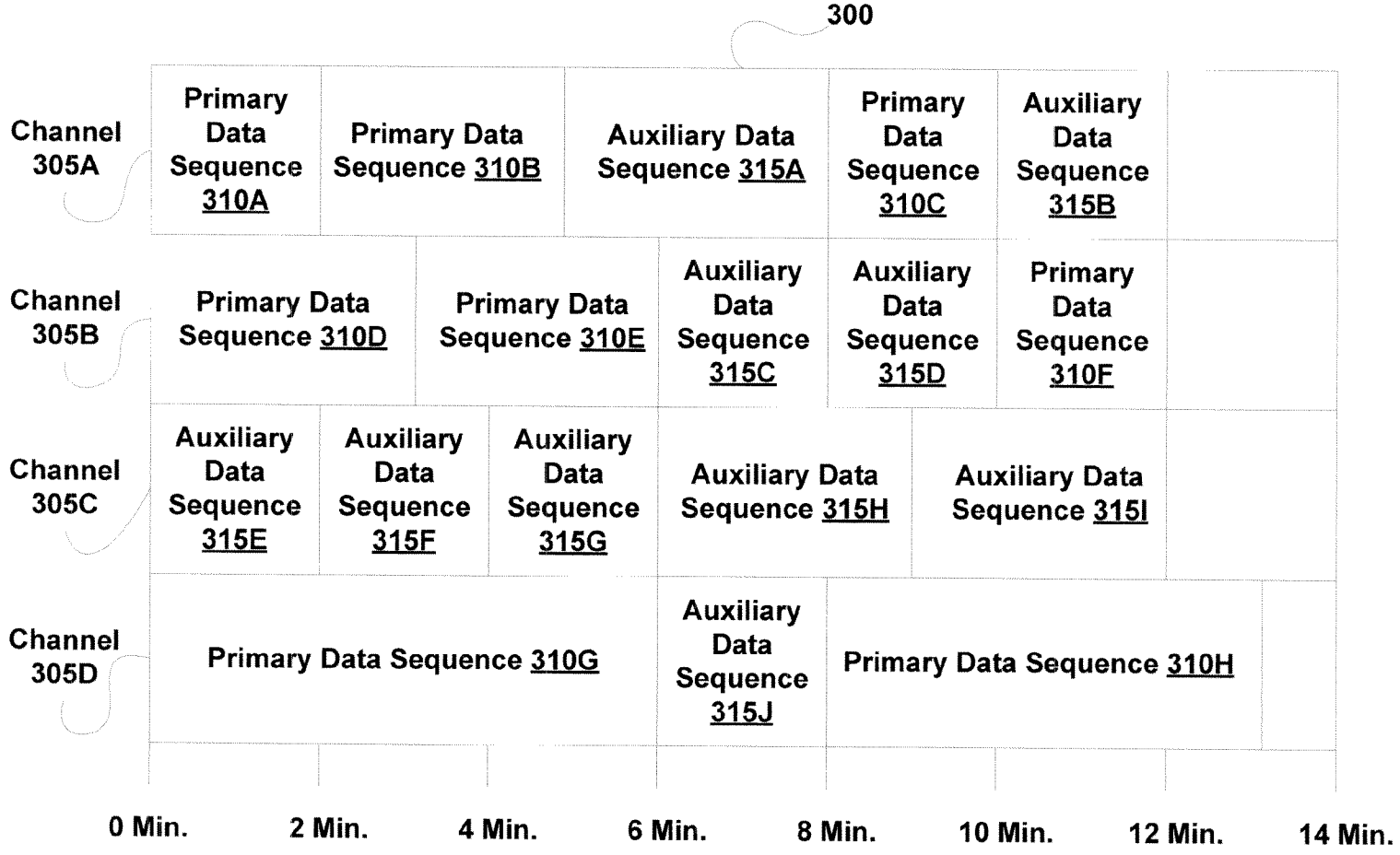
FIG. 3 illustrates an embodiment of transmission data as a function of transmission time, according to various embodiments of the invention.

FIG. 3 illustrates an embodiment of Transmission Data 300 as a function of transmission time, as may be included in one or more Transmission 120 broadcast by Transmitter 110 and received by Receivers 150A and 150B. This particular embodiment of Transmission Data 300 includes four separate Channels 305A-305D. In alternative embodiments, Transmission Data 300 includes one channel, two channels, three channels, or more than four channels. Each of Channels 305A-305D is optionally associated with a particular and/or separate wireless frequency, data path, television channel, radio frequency band, Transmission 120, Transmitter 110, or the like.

Within each of Channel 305A-305D are Primary Data Sequences 310, designated 310A-310H, and Auxiliary Data Sequences 315, designated 315A-315J. The actual number of Primary Data Sequences 310 and Auxiliary Data Sequences 315 in any particular Channel 305A-305D can vary significantly in alternative embodiments. Some channels, e.g., Channel 305C, optionally include only Auxiliary Data Sequences 315. The length of individual Primary Data Sequences 310A-310H and Auxiliary Data Sequences 315A-315J may vary substantially in alternative embodiments. For example, Auxiliary Data Sequence 315J can be less then a few seconds, or many tens of minutes or hours.

In some embodiments, Auxiliary Data Sequences 315 include an advertisement, an news story, a scene in a movie or television program, a traffic report, an emergency services message, a television program, a movie, a sports program, an alternative ending, an audio signal, a video signal, and/or the like.

There are at least three alternative approaches by which Output Assembler 225 can use Transmission Data 300 to generate output data, a "substitution approach," a "selection approach," and an "insertion approach." First, in some embodiments using the substitution approach, data in first member of Channel 305A-305D, e.g., Channel 305A, is received at the same rate as it would be presented to a user. For example, 5 minutes of television programming is received in a 5-minute period. In these embodiments, the data received in Channel 305A is optionally considered default data that would be passed directly to Output Device 255 in the absence of configuration factors. When data is received in Channel 305A at the same rate that it would be presented to a user, Output Assembler 225 is configured to replace Auxiliary Data Sequences 315 included in Channel 305A of Transmission Data 300, as received from Receiver 150A, with Auxiliary Data Sequences 315 received in Channels 305B-305C, responsive to customization factors. Thus, the excess information is distributed among more than one of Channels 305A-305D. For example, Auxiliary Data Sequence 315B may be replaced by Auxiliary Data Sequence 315C, or Auxiliary Data Sequence 315A may be replaced by Auxiliary Data Sequence 315H. Typically, when the replacement Auxiliary Data Sequence 315H is received after the Auxiliary Data Sequence 315A being replaced, Data Buffer 220 is used to temporally store parts of Transmission Data 300 such that some of Auxiliary Data Sequence 315H is received before discarding any of Auxiliary Data Sequence 315A.

A member of Auxiliary Data Sequences 315 is optionally received a substantial time before it is included in output data. For example, a member of Auxiliary Data Sequences 315 including a television advertisement may be received by Signal Receiver 205 during a period in which Output Device 255 is turned off, e.g., at 2:00 AM. Later, when a user turns on Output Device 255, e.g., at 7:00 PM, the received television advertisement is included in output data of Output Assembler 255. Thus, Receiver 150A is optionally used to store an advertisement until a user is watching television or listening to the radio, and then insert the stored advertisement into output data for presentation to the user through Output Device 255. In this way an advertiser can be assured that an advertisement will be presented to a user, regardless of which time of day the user turns on Output Device 255.

In embodiments using the selection approach, the rate of data transmission within a particular member of Channels 305A-305D is greater than the rate at which data is presented to a user. Thus, excess information is included in a single transmission channel that has excess bandwidth. For example, the data transmitted in 12 minutes in Channel 305B, as shown in FIG. 3, may include data that would normally be presented to a user in a 14 minute period. Thus, there is 2 minutes of excess information. In the selection approach, Output Assembler 225 is configured to select which of the Auxiliary Data Sequences 315C or 315D should be included in output data and which should be discarded. In the present example, 2 minutes of auxiliary data will be discarded. Output Assembler 225 is configured to selected one of Auxiliary data Sequence 315C and Auxiliary Data Sequence 315D for inclusion in the output data, and the other of Auxiliary Data Sequence 315C and Auxiliary Data Sequence 315D to be discarded, responsive to customization factors. By discarding a 2-minute member of Auxiliary Data Sequences 315, output data of 12 minutes is obtained. This output data can be presented to a user in near real time.

In some embodiments, Output Assembler 225 is configured to use the substitution approach, insertion approach, and the selection approach in various combinations. Typically, the substitution and selection processes are made using metadata included in Transmission Data 300. This metadata is optionally included in Primary Data Sequences 310 or Auxiliary Data Sequences 315, or received through a separate part of Transmission Data 300.

In embodiments using the insertion approach, Primary Data Sequences 310 are separated by insertion metatags configured to indicate appropriate positions for insertion of Auxiliary Data Sequences 315. The insertion metatags optionally include metadata for comparison with customization factors. The results of these comparisons are used to determine which, if any, Auxiliary Data Sequences 315 should be inserted at a particular position.

Alternative embodiments include different ratios of data transmission rates to data presentation rates. In some cases data transmission rates are several times higher than presentation rates and more than half of the transmitted data is discarded. In some cases data transmission rates are only slightly greater than data presentation rates and only a fraction of the transmitted data is discarded. In some embodiments the ratio of transmission rates and presentation rates are dependent on the time of day.

Figure 4:
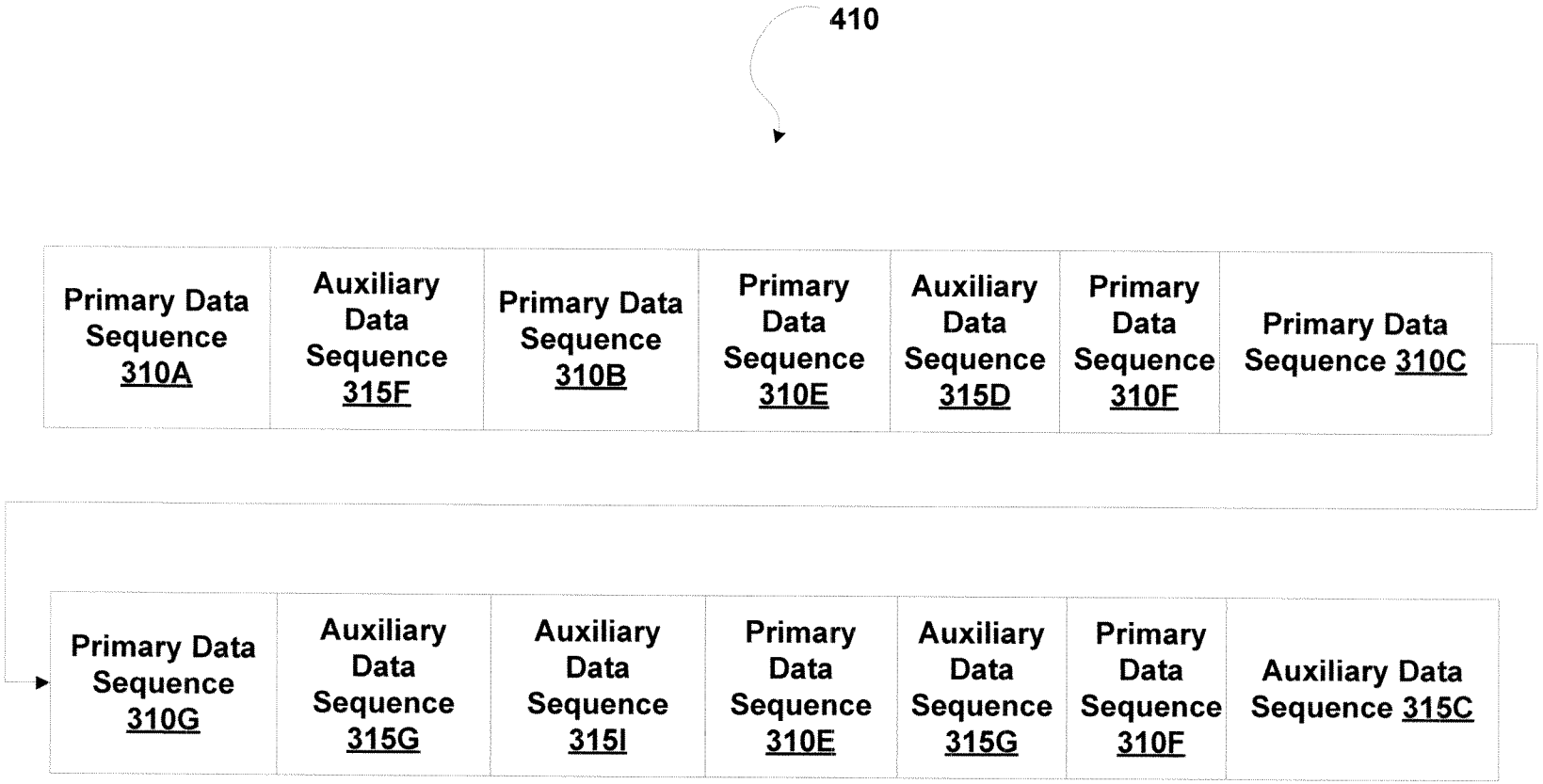
FIG. 4 illustrates a data output, according to various embodiments of the invention.

FIG. 4 illustrates an Output Data 410 of Output Assembler 225 according to one embodiment of the invention. Output Data 410 may be generated, for example from Transmission 300 and a set of customization factors. In the embodiment illustrated, some Auxiliary Data Sequences 315 have be used to replace default Auxiliary Data Sequences 315, and some members of Auxiliary Data Sequences 315 have been selected over other members of Auxiliary data Sequences 315. Typically, before delivery to Output Device 255, some or all metadata is stripped from Output Data 410. The orders of Primary Data Sequences 310 and Secondary Data Sequences 315 are optionally different in Output Data 410, than the orders in which they received in Transmission 300.

Figure 5:
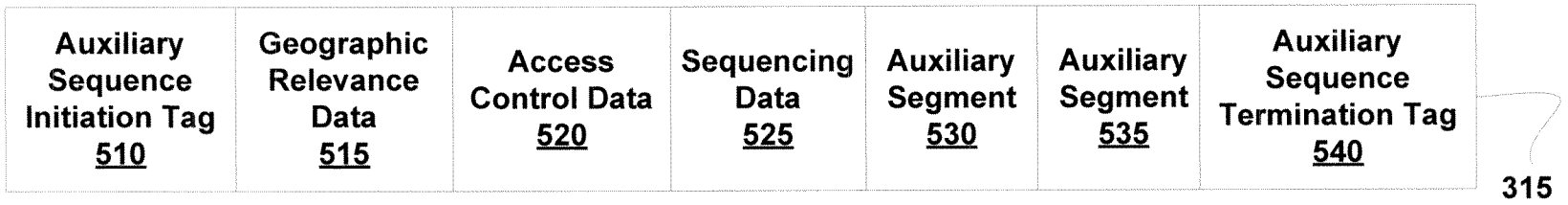
FIG. 5 illustrates further detail of an auxiliary data sequence, according to various embodiments of the invention.

FIG. 5 illustrates further detail of a member of Auxiliary Data Sequences 315, according to various embodiments of the invention. The Auxiliary Data Sequence 315 illustrated includes an optional Auxiliary Sequence Initiation Tag 510, optional Geographic Relevance Data 515, optional Access Control Data 520, optional Sequencing Data 525, an Auxiliary Segment 530, an optional Auxiliary Segment 535, and an optional Auxiliary Sequence Termination Tag 540. Auxiliary Sequence Initiation Tag 510 and Auxiliary Sequence Termination Tag 540 are metadata configured for identifying the beginning and ending of Auxiliary Data Sequence 315. They are optional when Auxiliary Data Sequence 315 is identified using other metadata or a timing schedule. For example, in some embodiments an instance of Auxiliary Data Sequence 315 is scheduled every 15 minutes and is predetermined to be 2 minutes long. In some embodiments, an Auxiliary Sequence 315 is selected based on a first level of customization factors, and Auxiliary Segment 530 or Auxiliary Segment 535, within the chosen Auxiliary Sequence 315, is then selected based on a second level of customization factors. These levels can be hierarchical.

Geographic Relevance Data 515 is data associated with at least one Auxiliary Segment 530 for use in determining if that Auxiliary Segment 530 should be included in Output Data 410 of Output Assembler 225. Thus, Geographic Relevance Data 515 is used to produce location dependent customization. For example Geographic Relevance Data 515 may be compared with a customization factor stored in Customization Factors Storage 230 to determine if Auxiliary Segment 530 of Auxiliary Data Sequence 315C should be substituted for Auxiliary Data Sequence 315B in Output Data 410. More specifically, in some embodiments, Geographic Relevance Data 515 includes one or more geographic locations and if one of these geographic locations matches a geographic location in the current customization factors, all or part of the associated Auxiliary Data Sequence 315C will be used to replace Auxiliary Data Sequence 315D in the output data of Output Assembler 225. In another example, the Geographic Relevance Data 515 associated with Auxiliary Data Sequence 315C and the Geographic Relevance Data 515 associated with Auxiliary Data Sequence 315D may both be compared with current customization factors, and based on these comparisons, one of Auxiliary Data Sequence 315C and Auxiliary Data Sequence 315D is selected for inclusion in Output Data 410 and the other discarded. The current customization factors can change as Receiver 150A or 150B move.

In one embodiment, Geographic Relevance Data 515 is associated with an advertisement for a restaurant. This Geographic Relevance Data 515 is configured such that only when customization factors includes a zip code or geographical location near the restaurant will the advertisement be included in Output Data 410 presented to a user. When such data is not included in the customization factors the advertisement is not included in Output Data 410 and an alternative, e.g., default, Auxiliary Data Sequence 315 is used instead.

In one embodiment, Geographic Relevance Data 515 is associated with a broadcast of a sporting event. In this embodiment there may be a desire to "blackout" the broadcast in an area near where the event will occur. Thus, Geographic Relevance Data 515 is configured such that the sporting event will only be presented to a user through Receiver 150A, if Receiver 150A is located outside of the blackout area.

In one embodiment, Geographic Relevance Data 515 is associated with a traffic report and Auxiliary Data Sequence 315D is selected over Auxiliary Data Sequence 315C if Receiver 150A includes a customization factor associated with a location of a traffic problem. In this embodiment, the customization factor optionally includes a route.

Some embodiments include a hierarchical set of Geographic Relevance Data 515. For example, if a location of a user is in California then a default instance of Auxiliary Data Sequence 315B may be replaced by Auxiliary Data Sequence 315E, if the location of the user is in Northern California then Auxiliary Data Sequence 315B may be replaced by Auxiliary Data Sequence 315F, and if the location of the user is in San Francisco then Auxiliary Data Sequence 315B may be replace by Auxiliary Data Sequence 315G.

In some embodiments, Geographic Relevance Data 515 is configured such that Auxiliary Data Sequence 315J is included in the Output Data 410 of Output Assembler 225 if it can be determined from customization factors that Receiver 150A is moving.

Access Control Data 520 includes data configured for limiting or providing access to Auxiliary Segment 530. For example, Access Control Data 520 may include a subscription key, a security code/key, a parental control, or the like. Output Assembler 225 is configured to compare Access Control Data 520 with customization factors stored in Customization Factors Storage 230 to determine of a particular Auxiliary Segment 530 should be included in Output Data 410 of Output Assembler 225. For example, in one embodiment, Access Control Data 520 is associated with Auxiliary Data Sequence 315F which includes a scene within a movie that may not be appropriate for all audiences. Unless appropriate values are found within customization factors, Output Data 410 will include a default or alternative member of Auxiliary Data Sequences 315, e.g., Auxiliary Data Sequence 315J, and Auxiliary Data Sequence 315F will not be used to replace Auxiliary Data Sequence 315J. Access Control Data 520 is used to determine which of a plurality of alternative Auxiliary Data Sequences 315 received from Transmitter 110 will be presented to a user, not merely to block a particular member of Auxiliary Data Sequences 315.

Sequencing Data 525 includes information on the allowed sequence of Primary Data Sequences 310 and Auxiliary Data Sequences 315 in Output Data 410. For example, Sequencing Data 525 may be configured to assure that the scenes in a movie are in proper order. In some embodiments, Sequencing Data 525 is configured to assure that advertisements will be included in programs whose audience is appropriate for the advertisement. For example, an advertisement appropriate for a particular demographic is included in a program whose audience is characterized by that demographic.

Auxiliary Segment 530 includes the data to be included in Output Data 410. For example, Auxiliary Segment 530 may include compressed or non-compressed audio data. An instance of Auxiliary Data Sequence 315 optionally includes more than one auxiliary segment, such as Auxiliary Segment 530 and Auxiliary Segment 535, etc. Herein, wherein the discussion refers to including one of Auxiliary Data Sequences 315 in Output Data 410 of Output Assembler 225, at least an instance of Auxiliary Segment 530, and optionally an instance of Auxiliary Segment 535, is included.

Geographic Relevance Data 515, Access Control Data 520, or Sequencing Data 525 are herein referred to as "criteria," and are optionally configured to apply to more than one instance of Auxiliary Data Sequence 315. Further, in alternative embodiments they may be included in an instance of Primary Data Sequence 310. In these embodiments, they are saved by Receiver 150A for later use in selection or substitution of Auxiliary Sequences 315.

Figure 6:
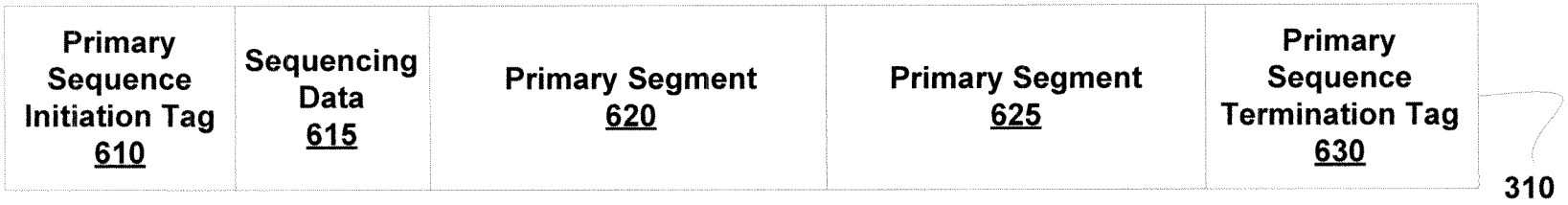
FIG. 6 illustrates an instance of a primary data sequence, according to various embodiments of the invention.

FIG. 6 illustrates an instance of Primary Data Sequences 310, according to some embodiments of the invention. Each member of Primary Data Sequences 310 includes at least one Primary Segment 620, and optionally one or more further Primary Segments 625. Primary Data Sequences 310 optionally further include a Primary Sequence Initiation Tag 610 and a Primary Sequence Termination Tag 630, configured to identify the start and end of a particular Primary Data Sequence 310. Primary Data Sequences 310 optionally further include Sequencing Data 615 similar to Sequencing Data 525.

Figure 7:
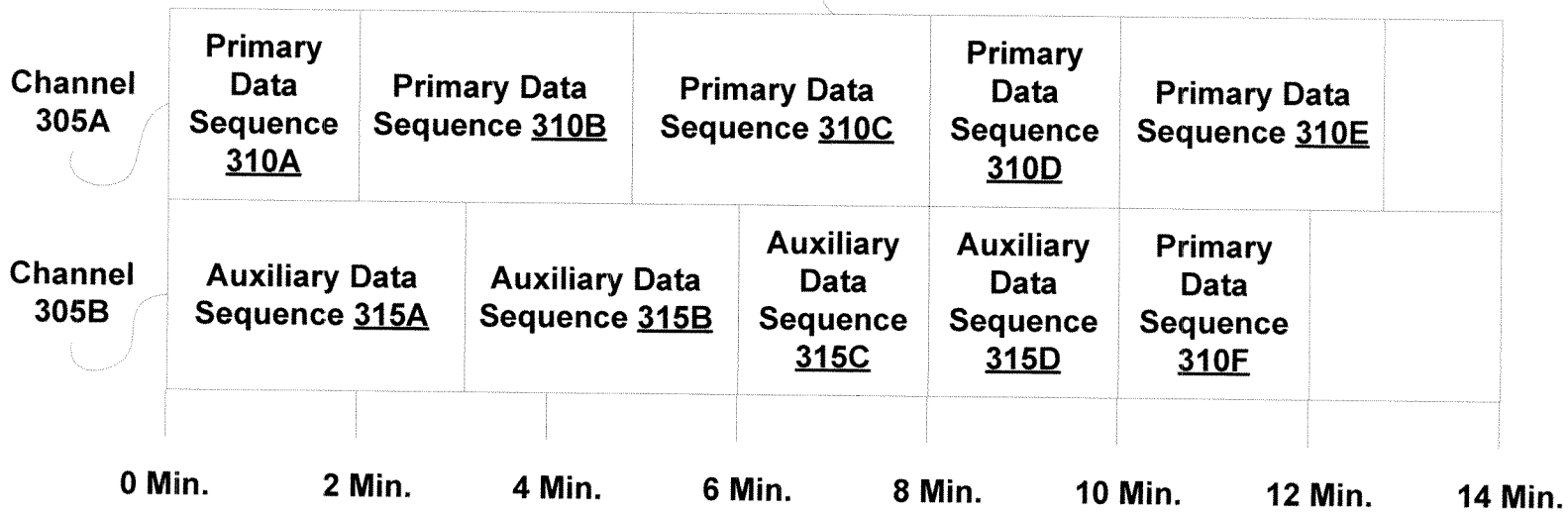
FIG. 7 illustrates an alternative embodiment of transmission data illustrated in FIG. 3, according to various embodiments of the invention.

FIG. 7 illustrates an alternative embodiment of Transmission Data 300 in which Channel 305A is used to transmit Primary Data Sequences 310 and Channel 305B is used to transmit Auxiliary Data Sequences 315. In these embodiments, metadata at the beginning or end of each of Primary Data Sequences 310 is used to identify positions in which one or more of Auxiliary Data Sequences 315 may be inserted in Output Data 410. The Auxiliary Data Sequences 315 in Channel 305B are optionally transmitted at a time significantly prior to the Primary Data Sequences 310 in Channel 305A.

The embodiment of Transmission Data 300 illustrated in FIG. 7 is optionally used in the insertion approach. In this case the Primary Data Sequences 310 in Channel 305A are separated by insertion tags and the Auxiliary Data Sequences 135 in Channel 305B are inserted at these insertion tags in response to criteria included in the insertion tags and customization factors.

Figure 8:
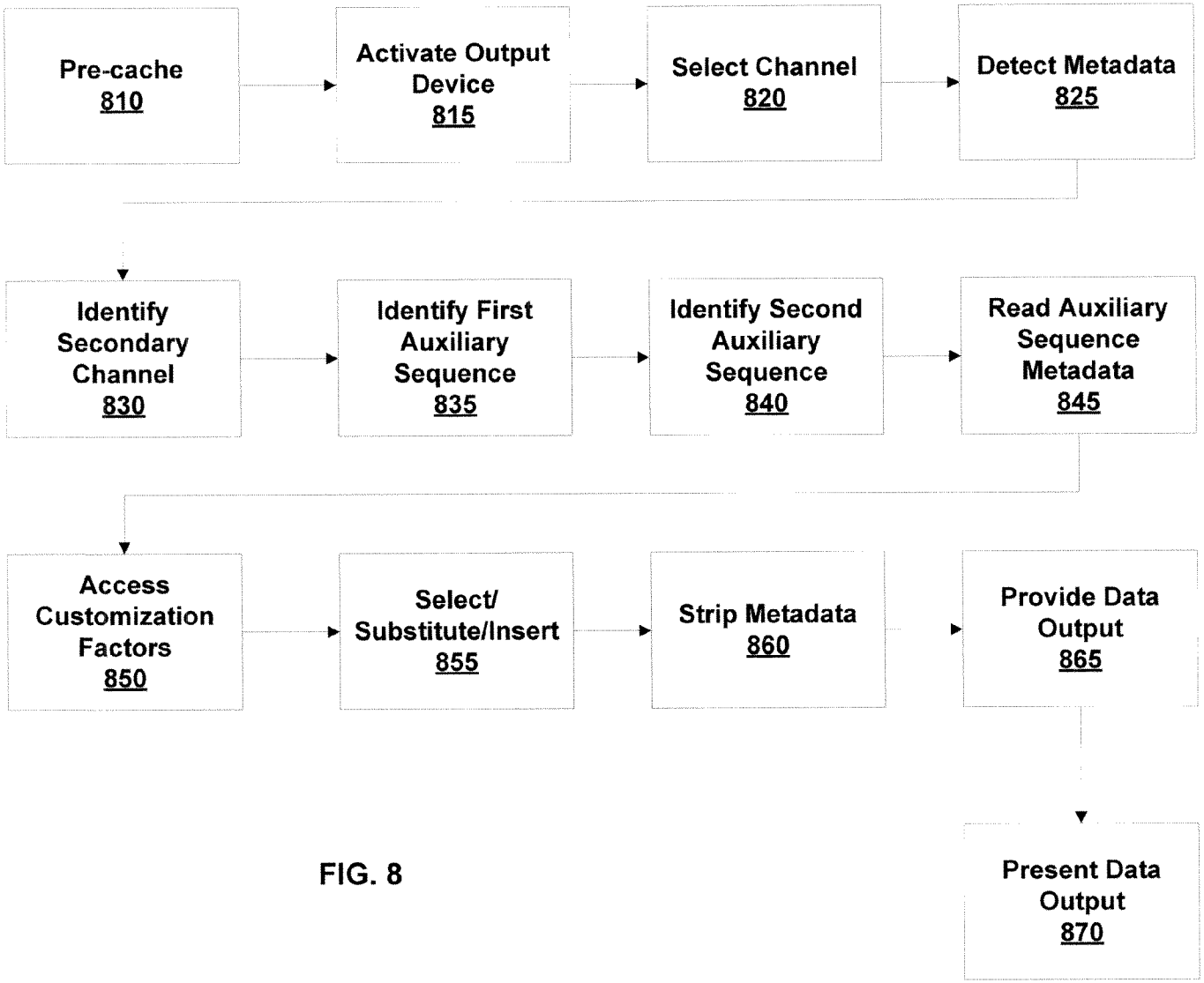
FIG. 8 illustrates a method of generating output data according to various embodiments of the invention.

FIG. 8 illustrates a method of generating Output Data 410 according to various embodiments of the invention. In this method, Transmission Data 300, or a part thereof, is broadcast by Transmitter 110 and received by Receivers 150A and 150B through the same transmission channel(s). Metadata within Transmission Data 300 and one or more customization factors are used to select which parts of Transmission Data 300 is presented to users and which parts are discarded. The customization factors may differ between Receiver 150A and Receiver 150B, and thus a user of Receiver 150A and a user of Receiver 150B can be presented different content resulting from the same broadcast received through the same transmission channel or channels. This results in customization in asymmetric communications. In some embodiments, Receiver 150A and Receiver 150B receiver the same data in Channel 305A, but Receiver 150A receives Channel 305B and Receiver 150B receives Channel 305C. For example, Channel 305A may be transmitted by satellite and Channels 305B and 305C may be transmitted by different local broadcast towers. Thus, Receivers 150A and 150B may both receive part of Transmission Data 300 including Primary Data Sequences 310 but receive different Auxiliary Data Sequences 315. The different Auxiliary Data Sequences 315 may be used to generate Output Data 410 using either the substitution approach or the insertion approach.

In an optional Pre-Cache Step 810, Transmission Data 300 is received by Signal Receiver 205 of Receivers 150A and 150B. This reception may occur while Output Device 255 is turned off. For example, in some embodiments, Receiver 150A includes a digital video recorder configured to record broadcasts while a television is off. The received Transmission Data 300, or parts thereof, is optionally stored in Data Buffer 220. For example, one or more Auxiliary Data Sequence included in Transmission Data 300 is optionally stored in Data Buffer 220 for later use in assembling Output Data 410.

In an Activate Output Device Step 815, a user activates Output Device 255 for display of Output Data 410. For example, in some embodiments Activate Output Device Step 815 includes turning on a television, game console, or radio. In various embodiments, Activate Output Device Step 815 can occur at any time prior to a Present Data Output Step 870, discussed below. Thus, any of steps 810-865 can occur prior to activating Output Device 255.

In an optional Select Channel Step 820, a default transmission channel is selected from Channels 305A-305D. In some embodiments, Primary Data Sequences 310 and Auxiliary Data Sequences included in the default transmission channel are presented to the user if no customization occurs. The selection of a default transmission channel may be made by a user, or alternatively may be predetermined. For example, if Receiver 150A is programmed to record a specific channel at a specific time, Select Channel Step 820 can be responsive to this program. In some embodiments, the default transmission channel is automatically associated with a secondary transmission channel. For example, in some embodiments, Auxiliary Data Sequences 315 for inclusion in Channel 305A are always found in Channel 305C.

In a Detect Metadata Step 825, Parser 215 is used to detect metadata within Transmission Data 300. The first detected metadata can be, for example, an Auxiliary Sequence Initiation Tag 510, a Primary Sequence Initiation Tag 610, Auxiliary Sequence Termination Tag 540, Primary Sequence Termination Tag 630, Sequencing Data 525, Sequencing Data 615, or other metadata included in Primary Data Sequences 310 or Auxiliary Data Sequences 315. The first detected metadata is typically used to determine whether the data being parsed using Parser 215 is Primary Data Sequence 310 or Auxiliary Data Sequence 315.

In an optional Identify Secondary Channel Step 830 another channel included in Transmission Data 300 is identified as a secondary channel. In the substitution approach, the secondary channel includes one or more Auxiliary Data Sequence 315 that can be used to replace one or more Auxiliary Data Sequences 315 included in the default transmission channel. In the insertion approach, the secondary channel includes one or more Auxiliary Data Sequences 315 for insertion between Primary Data Sequences 310 included in the primary channel. Identify Secondary Channel Step 830 is optionally responsive to the metadata detected in Detect Metadata Step 825. For example, in some embodiments, the metadata detected in Detect Metadata Step 825 is Sequencing Data 525 or Sequencing Data 615 that includes an identity of an associated secondary channel. Identify Secondary Channel Step 830 is not required in the selection approach.

In an Identify First Auxiliary Sequence Step 835 a first Auxiliary Sequence 315 in the default transmission channel is identified. In an Identify Second Auxiliary Sequence Step 840 a second Auxiliary Sequence 315 is identified. When using the substitution approach, the second Auxiliary Sequence 315 is typically in the secondary channel, and the first Auxiliary Sequence 315 is subject to replacement by the first Auxiliary Sequence 315. When using the selection approach the second Auxiliary Sequence 315 is typically in the default channel, and Output Assembler 225 is configured to select between the first Auxiliary Sequence 315 and the second Auxiliary Sequence 315 for inclusion in Output Data 410. The second Auxiliary Sequence 315 was optionally cached in Pre-cache Step 810. In the insertion approach, Identify First Auxiliary Sequence Step 835 is replaced by a step in which an insertion point is identified in the default transmission channel.

In a Read Auxiliary Sequence Criteria Step 845, one or more criteria used for determining whether the second Auxiliary Sequence 315 should be included in Output Data 410 is accessed by Output Assembler 225. This criteria includes, for example, Geographic Relevance Data 515, Access Control Data 520, Sequencing Data 525, or the like. In some embodiments, this criteria is included elsewhere in Transmission Data 300.

In an Access Customization Factors Step 850, one or more customization factors, such as those stored in Customization Factors Storage 230 are accessed. The access process may include a database query, a hash table look up, reading a data file, or the like. In some embodiments, Access Customization Factors Step 850 is responsive to the criteria read in Read Auxiliary Sequence Criteria Step 845. For example, if Geographic Relevance Data 515 is read in Read Auxiliary Sequence Criteria Step 845, then customization factors relating to geographic relevance may be specifically looked for in Access Customization Factors Step 850.

In a Select/Substitute/Insert Step 855 a comparison is made between the criteria read in Read Auxiliary Sequence Criteria Step 845 and the customization factors accessed in Access Customization Factors Step 850. The results of this comparison is then used to determine if the second Auxiliary Sequence 315 should be selected over, or used to replace, the first Auxiliary Sequence 315. Or, in the insertion approach, the results of this comparison is then used to determine if the second Auxiliary Sequence 315 should be inserted at an insertion point between Primary Sequences 310. For example, if the criteria includes that a specific access key be provided and that access key is found in the customization factors, then the second Auxiliary Sequence 315 is included in Output Data 410. Likewise, if the criteria include a specific geographic area and the customization factors include a location of a user that is within that geographic area, then the second Auxiliary Sequence 315 is included in Output Data 410. If the criteria are not met by the customization factors then the first Auxiliary Sequence 315 is included in Output Data 410 rather than the second Auxiliary Sequence 315.

In an optional Strip Metadata Step 860 any unnecessary metadata is removed from Output Data 410. In a Provide Data Output Step 865 the resulting Output Data 410 is provided to Output Device 255. In Present Data Output 870, Output Device 255 is used to present Output Data 410 to a user. The presented Output Data 410 is a combination of Primary Sequences 310 and Auxiliary Sequences 315, inclusion of the Auxiliary Sequences 315 being responsive to customization factors. In various embodiments Output Data 410 is presented as an audio stream, as a video stream, or as an audio/video stream.

Figure 9:
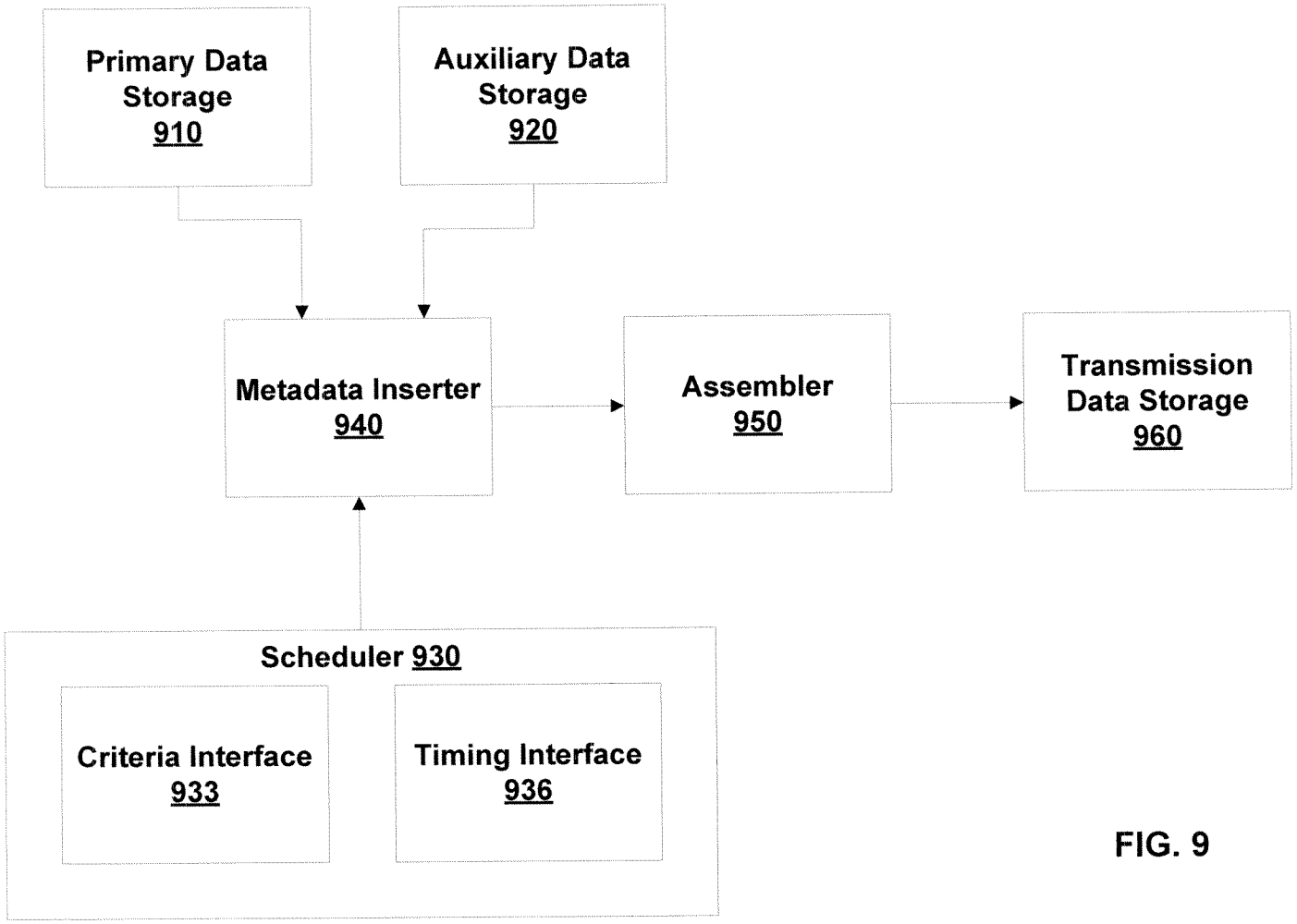
FIG. 9 illustrates a transmission data assembly system, according to various embodiments of the invention.

FIG. 9 illustrates a Transmission Data Assembly System, generally designated 900, according to various embodiments of the invention. Transmission Data Assembler 900 is configured for generating Transmission Data 300 prior to transmission by Transmitter 110. Transmission Data Assembler 900 includes Auxiliary Data Storage 920, a Scheduler 930, a Metadata Inserter 940, an Assembler 950, and an optional Transmission Data Storage 960.

Primary Data Storage 910 is configured to store data that will eventually be included in one or more Primary Sequence 310, for example as Primary Segment 620 or Primary Segment 625. The data stored in Primary Data Storage 910 can be, for example, a movie, a television program, a sound recording, a news program, or the like.

Auxiliary Data Storage 920 configured to store data that will eventually be included in one or more Auxiliary Sequence 315. This data may include, for example, an advertisement, a traffic report, local news, a scene from a movie or television show, a lecture, music, video, audio, or the like. Primary Data Storage 910 and Auxiliary Data Storage 920 each optionally include a database, a computer network, analog or digital storage devices, a data server, or the like.

Scheduler 930 includes a Criteria Interface 933 and an optional Timing Interface 936. Criteria Interface 933 is configured for an administrator to set criteria for inclusion in Auxiliary Sequences 315 and Timing Interface 936 is configured to schedule the inclusion of Auxiliary Sequences 315 in Output Data 410. For example, in some embodiments, Criteria Interface 933 is used to associate criteria such as Geographic Relevance Data 515 and Access Control Data 520 with data stored in Auxiliary Data Storage 920. In one embodiment, Criteria Interface 933 is configured to define criteria requiring that the location of a user must be within a specified area in order for a specific instance of Auxiliary Sequences 315 to be included in Output Data 410. In one embodiment, Criteria Interface 933 is configured to define criteria requiring a specific subscription key in order for a specific instance of Auxiliary Sequences 315 to be included in Output Data 410.

Timing Interface 936 is optionally further configured to define Sequencing Data 525 and Sequencing Data 615. For example, Timing Interface 936 is optionally configured to determine the order in which Primary Sequences 310 and Auxiliary Sequences 315 are included in Output Data 410. In some embodiments Timing Interface 936 is configured to specify which Auxiliary Sequences 315 can be substituted for each other, or must be chosen between. For example, Timing Interface 936 may be used to specify that three alternate Auxiliary Sequences 315 may alternatively be placed at a specific location within a Primary Sequence 310. Customization factors are used to determine which of the three are actually presented to a user at the specific location. In one embodiment, Timing Interface 936 is configured to determine if a particular Auxiliary Sequence 315 is subject to the substitution approach or the selection approach, or both. In one embodiment, Timing Interface 936 is configured for specifying a channel for transmission of one or more Auxiliary Sequences 315.

Metadata Inserter 940 is configured to combine various metadata into data retrieved from Primary Data Storage 910 and Auxiliary Data Storage 920, in order to generate Primary Sequences 310 and Auxiliary Sequences 315, respectively. For example, Metadata Inserter 940 is optionally configured to combine Primary Sequence Initiation Tag 610, Primary Sequence Termination Tag 630 and/or Sequencing Data 615 with data retrieved from Primary Data Storage 910. In another example, Metadata Inserter 940 is configured to combine Auxiliary Sequences Initiation Tag 510, Geographic Relevance Data 515, Access Control Data 520, Sequencing Data 525, and/or Auxiliary Sequence Termination Tag 540 into data retrieved from Auxiliary Data Storage 920. The combinations produced by Metadata Inserter 940 are responsive to input (e.g., criteria) received from an administrator using Scheduler 930. For example, criteria defined using Criteria Interface 933 is optionally included in Geographic Relevance Data 515 and combined with data retrieved from Auxiliary Data Storage 920 to generate Auxiliary Sequence 315.

Assembler 950 is configured to assemble Primary Sequences 310 and Auxiliary Sequences 315 generated using Metadata Inserter 940 into Transmission Data 300 prior to transmission by Transmitter 110. In some embodiments, Assembler 950 is configured to order the assembled Primary Sequences 310 and Auxiliary Sequence 315 to minimize delay times and buffer storage at Receiver 150A. For example, Assembler 950 may be configured to assure that Auxiliary Sequences 315 are available for inclusion in Output Data 410 before Output Data 410 is needed for presentation to a user. Transmission Data Storage 960 is configured to store the Transmission Data 300 assembled by Assembler 950 prior to transmission by Transmitter 110.

Figure 10:
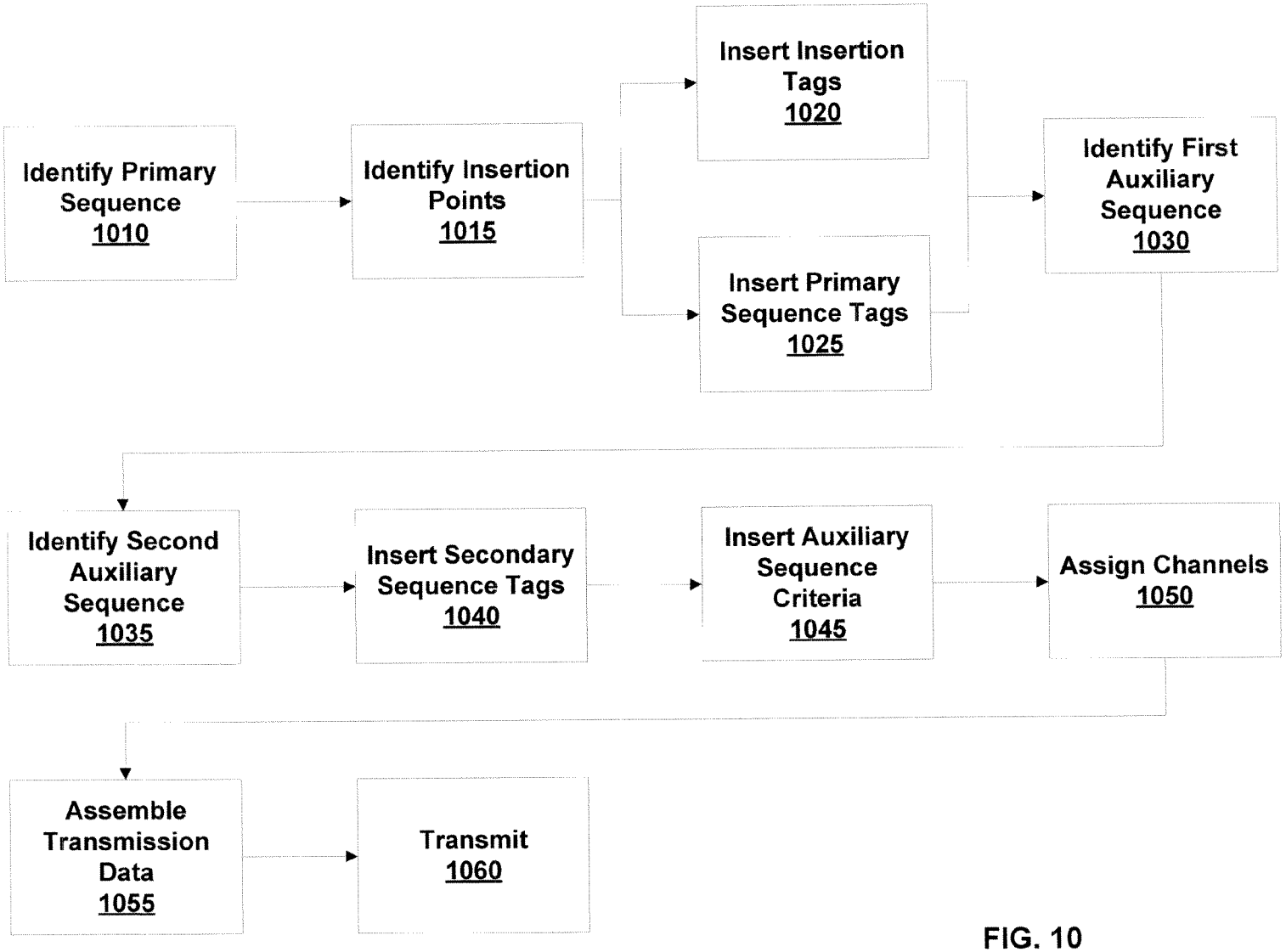
FIG. 10 illustrates a method of generating transmission data, according to various embodiments of the invention.

FIG. 10 illustrates a method of generating Transmission Data 300 according to various embodiments of the invention. The method of FIG. 10 is optionally performed using the system of FIG. 9.

In an Identify Primary Sequence Step 1010, data is read from Primary Data Storage 910 for inclusion in one or more Primary Sequences 310. This data is optionally, video and/or audio data, etc. In an optionally Identify Insertion Points Step 1015, one or more points within or between the data read in Identify Primary Sequence Step 1010 is identified for insertion of data read from Auxiliary Data Storage 920.

In an optional Insert Insertion Tags Step 1020, metadata is inserted at the points identified in Identify Insertion Points Step 1015. Alternatively, in an Insert Primary Sequence Tags Step 1025, Primary Sequence Initiation Tag 610, Sequencing Data 615 and/or Primary Sequence Termination Tag 630 are combined with the data read from Primary Data Storage 910.

In an Identify First Auxiliary Sequence Step 1030, first data is read from Auxiliary Data Storage 920 for inclusion in a first Auxiliary Sequence 315. This first data can include, for example, an advertisement, video data, a scene from a television show or movie, audio data, a news report, traffic information, music, or the like.

In an Identify Second Auxiliary Sequence Step 1035, second data is read from Auxiliary Data Storage 920 for inclusion in a second Auxiliary Sequence 315. The second Auxiliary Sequence 315 being configured to replace the first Auxiliary Sequence 315, to be selected in preference to the first Auxiliary Sequence 315, or to be inserted between Primary Sequences 310, responsive to customization factors and criteria included in the second Auxiliary Sequence 315.

In an optional Insert Secondary Sequence Tags Step 1040, an Auxiliary Sequence Initiation Tag 510 and/or an Auxiliary Sequence Termination Tag 540 is combined with the second data read in Identify Second Auxiliary Sequence Step 1035.

Insert Auxiliary Sequence Criteria Step 1045 the criteria (e.g., Geographic Relevance Data 515, Access Control Data 520, and/or Sequencing Data 525) is combined with the second data read in Identify Second Auxiliary Sequence Step 1035 to generate a Auxiliary Sequence 315, using Metadata Inserter 940. In some embodiments, the first data read in Identify First Auxiliary Sequence Step 1030 is also combined with such criteria. However, in some embodiments, in an instance of Auxiliary Sequence 315 that is part of a default channel may not include these criteria.

In an Assign Channels Step 1050, Assembler 950 is used to assign the first and second Auxiliary Sequences 315 to one or more of Channels 305A-305D within Transmission Data 300. In an Assemble Transmission Data Step 1055 the first and second Auxiliary Sequences 315, optionally combined with any Primary Sequences 310, are assembled into Transmission Data 300. The Transmission Data 300 is optionally stored in Transmission Data Storage 960.

In an optional Transmit Step 1060 the Transmission Data 300 is broadcast to a plurality of Receivers 150A and 150B using Transmitter 110. This broadcast is typically, a one-way transmission (e.g., asymmetric) from a transmitter to many receivers. In some embodiments, Transmitter 110 is unaware of which or how many of Receivers 150A and 150B are receiving the transmission.

In one embodiment of the invention, contributors to public broadcasting are given a subscription key to access Auxiliary Sequences 315 that include desirable programming. Those without a subscription key are presented with default Auxiliary Sequences 315 that includes solicitations for fundraising or commercials.

In one embodiment of the invention, a first set, e.g., the defaults set, of Auxiliary Sequences 315 is tailored toward a general audience and a second set of Auxiliary Sequences 315 is tailored toward an adult audience. An access key is required to view the adult oriented Auxiliary Sequences 315.

Some embodiments of the invention include the sale of advertising on a geographic basis. For example, local pizza parlors may pay to have ads presented to user only when a location of the user is within each parlor's vicinity. It is contemplated that such establishments will be willing to pay more to reach an audience that is more likely to purchase their product, by virtue of their being close enough to do so without great inconvenience. Thus, using embodiments of the present invention, broadcasters may sell advertising based on geographical targeting ability or pricing models involving audience size.

In some embodiments of the invention, news and information is targeted on the basis of geographic relevance. For instance, travelers on a particular freeway receive reports of traffic and accidents near their current location, rather than at distant locations. Or, a national news broadcast can include local news segments in the form of Auxiliary Sequences 315.

In general, any usage model requiring or benefiting from restricting or allowing access to broadcast information based on geographic location may benefit from embodiments of the invention. For instance, military broadcasting can send messages for troops that are only received in areas of geographic relevance. However, appropriate command posts may still receive the entire transmission by systems programmed to receive, process, and present most or all Auxiliary Sequences 315 in Transmission 300.

In some embodiments, systems and methods of the invention are used for dispatching emergency services or taxis based on geographic relevance information, which allows users unconcerned with what is going on in geographically irrelevant areas to avoid having to hear about those matters.

In some embodiments a transmission includes Auxiliary Sequences 315 but not Primary Sequences 310. In these embodiments, a Receiver 150 may not present any information to a user if the comparison between criteria for use in selecting content does not compare favorably with one or more customization factors. As mentioned in the military and taxi dispatching embodiments discussed above, this allows a user to avoid having to hear certain information and allows the broadcaster to communicate on the basis of geographic location or some other customization factor.

Figure 11:
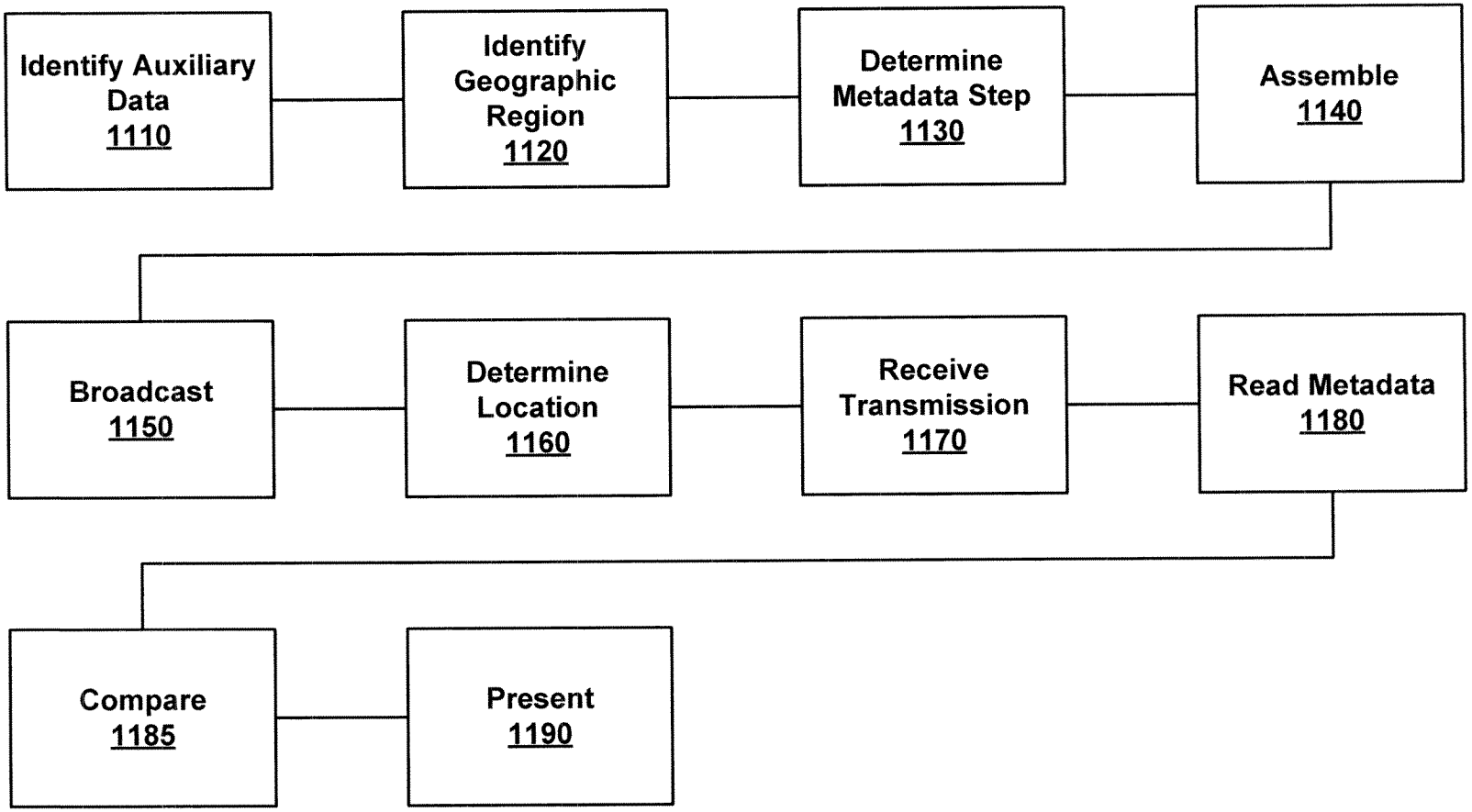
FIG. 11 illustrates a method of communicating to users in a specific geographical region.

For example, in some embodiments a broadcaster wishes to broadcast a message to Receiver 150 within a specific geographical region, e.g., Area 140A, at the exclusion of other regions. FIG. 11 illustrates a method of communicating to users in a specific geographical region, according to various embodiments of the invention. In these embodiments Primary Data Sequences 310 are optional and some Receivers 150 may not present any messages to a user. Further, in these embodiments, the total amount of information broadcast may be less that would normally be presented to a user in real time, as substantial time may pass between broadcasts. For example, a Taxi dispatcher may only be broadcasting ten percent of the time. However, the total amount of messages broadcast is more than is presented to any one user. Part of the messages broadcast is not presented to a user based on location of that user.

The method illustrated in FIG. 11 includes an Identify Auxiliary Data Step 1110 in which the message to be broadcast is identified. Identify Auxiliary Data Step 1110 may include receiving the message from an external source such as a computing device, a recording device, or a microphone. The message is an embodiment of Auxiliary Data Stream 315 and is optionally stored in Auxiliary Data Storage 920. More than one message may be identified in Identify Auxiliary Data Step 1110. Identify Auxiliary Data Step 1110 is an alternative embodiment of Identify First Auxiliary Sequence Step 1030 and/or Identify Second Auxiliary Sequence Step 1035, or Identify First Auxiliary Sequence Step 835 and/or Identify Second Auxiliary Sequence Step 840.

In an Identify Geographic Region Step 1120, a geographic region in which the message is to be presented to one or more users is identified. The geographic region may be, for example, Area 140A and/or 140B. It can be identified in a wide variety of ways. For example, in some embodiments the geographic region is identified by providing map coordinates (e.g., longitude and latitude). In some embodiments the geographic region is identified by marking on a digital map displayed using a computing device. For example, a region on a map could be marked using a pointing device or a touch sensitive screen. In some embodiments the geographic region is identified by accessing stored natural or geopolitical boundaries. The geographic region may be continuous or include separate parts.

In a Determine Metadata Step 1130, metadata representative of the identified geographic region is determined. This step is optionally performed using Metadata Inserter 940. In a typical embodiment, Determine Metadata Step 1130 includes converting geographic data from a form in which the geographic region is identified to a form in which it can be combined with one of Auxiliary Data Sequences 315. This can include addition of metatags around the geographic data. In some embodiments, the determined metadata includes information indicating whether the geographic region is a region in which presentation of the message to a user should be included or excluded. Identify Geographic Region Step 1120 is optionally included in Determine Metadata Step 1130.

In an Assemble Step 1140, the message(s) identified in Identify Auxiliary Data Step 1110 and the metadata determined in Determine Metadata Step 1130 are combined into Transmission Data 300. Assemble Step 1140 is optionally performed using Metadata Inserter 940 and/or Assembler 950. The resulting Transmission Data 300 does not necessarily include any Primary Data Sequence 310. Assemble Step 1140 is an alternative embodiment of Insert Insertion Tags Step 1020, Insert Primary Sequence Tags Step 1025, Insert Secondary Sequence Tags Step 1040 and/or Insert Auxiliary Sequence Criteria Step 1045.

In a Broadcast Step 1150 the Transmission Data 300 is broadcast using one or more Transmitter 110. This broadcast is typically a communication not addressed to a specific receiver. The broadcast can be wireless and/or wired. For example, the broadcast can be made using radio or television signals, or over a cable or fiber optic system. Broadcast Step 1150 is an alternative embodiment of Transmit Step 1060.

In a Determine Location Step 1160, a location of a Receiver 150A or 150B is determined. This determination is typically made the receiver. For example, in some embodiments Receiver 150A includes a global positioning system (GPS) configured to determine the location of Receiver 150A based on the receipt of signals from satellites. The location of the Receiver 150A or 150B may be based on a variety of alternative systems, such as signals from cellular communication towers, local radio station reception, data entered by a user, and/or the like. In some embodiments, Determine Location Step 1160 includes receiving location information from a user. This information may be entered using an actual or virtual keypad and may include a map coordinate, a global coordinate (such as longitude and latitude, etc.), a geopolitical location (such as a zip code, city or county, etc.), and/or the like. Receiver 150A optionally includes the systems configured to determine the location, such as Geographic Location Device 240. These systems are used to determine the location of Receiver 150A or 150B in Determine Location Step 1160. Determine Location Step 1160 is an alternative embodiment of Access Customization Factors Step 850.

In a Receive Transmission Step 1170 the Transmission Data 300 broadcast in Broadcast Step 1150 is received by Receiver 150A or 150B. This step is typically accomplished using Signal Receiver 205.

In a Read Metadata Step 1180 metadata included within the Transmission Data 300 is read. This step is optionally performed using Parser 215 and the read metadata can be stored in Data Buffer 220. Read Metadata Step 1180 is an alternative embodiment of Detect Metadata Step 825.

In a Compare Step 1185 the metadata read in Read Metadata Step 1180 is compared with the location determined in Determine Location Step 1160. Compare Step 1185 is optionally performed using Output Assembler 225. The result of this comparison is used to determine if the message included in the Transmission Data 300 should or should not be presented to a user of the Receiver 150A (or 150B). For example, in some embodiments, if the determined location is within the geographic region defined by the metadata then the message should be presented to the user. And if the determined location is not within the geographic region defined by the metadata then the message should not be presented to the user. Other embodiments use the reverse logic, e.g., if the determined location is not within the geographic regions defined by the metadata then the message should be presented to the user. The metadata optionally includes a flag configured to indicate which of the above logics should be applied and Output Assembler 225 can be configured to use the appropriate logic in response to whether the flag is set or not. Compare Step 1185 is an alternative embodiment of Select/Substitute/Insert Step 855.

In a Present Step 1190 the message is presented to a user of Receiver 150A if the comparison in Compare Step 1185 is favorable, e.g., indicates that the presentation should be made. The presentation may be audio and/or video and made using Output Device 255. The presentation is only made if the comparison in Compare Step 1185 is favorable. Present Step 1190 is an alternative embodiment of Present Data Output Step 870.

Steps 1110 through 1150 may be performed by one party while Steps 1160 through 1190 are performed by another party. Steps 1160 through 1190 may occur at several different Receiver 150 in parallel as a result of a single transmission in Broadcast Step 1150. The steps illustrated in FIG. 11 may be repeated for different geographic regions. Thus Receiver 150A may present some messages to the user and not present other messages. The selection of which messages are presented depends on the location of Receiver 150.

In some embodiments, systems and methods of the invention are used to provide local advertising through state wide or national broadcasting networks. For example, local advertising and other programming can be provided through satellite television, XM Radio or the Sirius Satellite Network.

In some embodiments, systems and methods of the invention are used to provide a variety of access levels to information. For example, a potential user of a content delivery service subscribes to a predetermined level of access. To verify that the user is authorized to access content transmitted in the signal, the user enters a private key which was received during the subscription process into his Receiver 150A. The Output Assembler 225 determines whether the issued private key matches a transmitted public key. Based on this determination a decrypted Auxiliary Sequence 315 is presented or not presented to the user.

In some embodiments of the invention Primary Sequences 310 or Auxiliary Sequences 315 includes deletion tags demarcating portions of content contained in the Primary Sequences 310 or Auxiliary Sequences 315 that are to be removed based on comparisons between criteria and customization factors.

Several embodiments of the invention are specifically illustrated and/or described herein. However, it will be appreciated that modifications and variations are covered by the above teachings and within the scope of the appended claims without departing from the spirit and intended scope thereof. For example, data included in Transmission Data 300 is optionally compressed. Data in Transmission Data 300 is optionally analog. In some embodiments, Output Buffer 250 is used for pre-caching Output Data 410. In some embodiments, Output Assembler 225 is configured to select between more than two Auxiliary Sequences 315. In some embodiments, all data sequences are Auxiliary Sequences 315. In these embodiments there are no Primary Sequences 310.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A method for automatically substituting programming with alternative programming, the method comprising:

receiving information indicating a first item of programming for playback at a radio;

automatically determining whether the first item of programming is acceptable, wherein said automatically determining does not receive user input directly specifying whether the first item of programming is acceptable; and in response to determining that the first item of programming is not acceptable, providing playback of alternative programming on the radio instead of the first item of programming.

2. The method of claim 1, wherein the alternative programming has a length of time that is close to the length of time of the first item of programming.

3. The method of claim 1, wherein the first item of programming comprises an advertisement.

4. A system comprising:

a radio frequency (RF) antenna configured to receive radio signals from radio stations;

a memory;

an input for receiving user input to control operation of the radio;

an output for providing audio signals to one or more speakers; and processing logic coupled to the RF antenna, the memory, the input, and the output, wherein the processing logic is configured to:

receive information indicating a first item of programming for playback, automatically determine whether the first item of programming is acceptable, wherein said automatically determining does not receive user input directly specifying whether the first item of programming is acceptable, and in response to determining that the first item of programming is not acceptable and that the memory has stored therein one or more audio files, process a first audio file of the one or more audio files to provide audio file audio signals to the output, wherein the audio file audio signals correspond to an alternative item of programming.

5. The system of claim 4, wherein the first item of programming is received for immediate playback via the RF antenna after said receiving the information.

6. The system of claim 4, wherein said automatically determining is performed using programming acceptability information of a current user, wherein the acceptability information is stored in the memory.

7. The system of claim 4, wherein the alternative programming has a length of time that is close to the length of time of the first item of programming.

8. The system of claim 4, wherein the first item of programming comprises an advertisement.

9. The system of claim 4, wherein the alternative programming comprises one or more songs.

* * * * *